US007037465B2

(12) United States Patent
Ogawa

(10) Patent No.: US 7,037,465 B2
(45) Date of Patent: May 2, 2006

(54) POWDER COMPACTING METHOD, POWDER COMPACTING APPARATUS AND METHOD FOR PRODUCING RARE EARTH MAGNET

(75) Inventor: Atsushi Ogawa, Mishima-gun (JP)

(73) Assignee: Neomax Co., Ltd., (JP)

( * ) Notice: Subject to any disclaimer, the term of this patent is extended or adjusted under 35 U.S.C. 154(b) by 309 days.

(21) Appl. No.: 10/415,748

(22) PCT Filed: Nov. 5, 2001

(86) PCT No.: PCT/JP01/09667

§ 371 (c)(1),
(2), (4) Date: May 2, 2003

(87) PCT Pub. No.: WO02/36335

PCT Pub. Date: May 10, 2002

(65) Prior Publication Data

US 2004/0101429 A1 May 27, 2004

(30) Foreign Application Priority Data

Nov. 6, 2000 (JP) ..... 2000-337364

(51) Int. Cl.
*B22F 1/00* (2006.01)
*B22F 1/02* (2006.01)

(52) U.S. Cl. ..... 419/38; 419/66; 425/78; 425/352; 425/354; 425/355; 148/101; 148/102; 148/103; 148/104

(58) Field of Classification Search ..... 419/38, 419/66; 425/78, 352, 354, 355; 148/101, 148/102, 103, 104
See application file for complete search history.

(56) References Cited

U.S. PATENT DOCUMENTS

| | | | | |
|---|---|---|---|---|
| 3,593,380 | A * | 7/1971 | Voronov et al. | 425/405.2 |
| 4,770,723 | A | 9/1988 | Sagawa et al. | |
| 4,792,368 | A | 12/1988 | Sagawa et al. | |
| 5,250,255 | A | 10/1993 | Sagawa et al. | |
| 5,383,978 | A | 1/1995 | Yamamoto et al. | |
| 5,449,481 | A * | 9/1995 | Sagawa et al. | 264/123 |
| 6,355,210 | B1 * | 3/2002 | Hirabayashi | 419/38 |
| 6,474,576 | B1 | 11/2002 | Oota et al. | |

FOREIGN PATENT DOCUMENTS

| | | |
|---|---|---|
| EP | 1 020 285 A2 | 7/2000 |
| JP | 51-136198 | 11/1976 |
| JP | 57-124599 | 8/1982 |
| JP | 61-196516 | 12/1986 |
| JP | 62-267401 | 11/1987 |
| JP | 63-110521 | 7/1988 |
| JP | 10-058198 | 3/1998 |
| JP | 2000-317696 | 11/2000 |
| JP | 2001-252792 | 9/2001 |

* cited by examiner

*Primary Examiner*—John P. Sheehan
(74) *Attorney, Agent, or Firm*—Nixon Peabody LLP; Jeffrey L. Costellia

(57) ABSTRACT

A powder compacting method includes the steps of: providing a powder material; loading the powder material into a cavity; uniaxially pressing the powder material, which has been loaded into the cavity, between two opposed press surfaces, thereby obtaining a compact, wherein at least one of the two press surfaces is deformed elastically under a compacting pressure when contacting with the powder material in the cavity; and unloading the compact from the cavity. According to this powder compacting method, even when the powder material has a non-uniform fill density distribution, a compact with a uniform density distribution can be obtained at a high productivity.

17 Claims, 13 Drawing Sheets

POWDER COMPACTING METHOD, POWDER COMPACTING APPARATUS AND METHOD FOR PRODUCING RARE EARTH MAGNET

TECHNICAL FIELD

The present invention relates to a method and apparatus for compacting a powder and a method for producing a magnet. More particularly, the present invention relates to a powder compacting method and apparatus that can be used effectively to compact a rare earth alloy powder and also relates to a method for producing a magnet out of a rare earth alloy powder.

BACKGROUND ART

A powder compacting technique is used to manufacture various types of parts to be made of a ceramic or a metal. For example, a sintered body of a ceramic or a metal is manufactured by sintering a compact that has been obtained in a predetermined shape by subjecting a powder material to a powder compaction process. By subjecting the sintered bodies to a finishing process thereafter to adjust the sizes and shapes thereof, final products are obtained.

Generally speaking, the quality of a sintered body (in terms of physical properties or configuration) is determined by the quality of a compact. Also, the compactability depends on the particle size distribution or the particle shapes of the powder material. For these reasons, various powder compacting methods have been proposed so far to obtain a compact of quality.

For example, a sintered magnet of a rare earth alloy may be produced by performing the process steps of:

(1) melting a material metal at a high temperature to obtain an ingot of a rare earth alloy with a predetermined composition;
(2) pulverizing this alloy ingot to obtain a rare earth alloy powder of a small size;
(3) compacting the resultant alloy powder (to the surface of which a lubricant is added depending on the necessity) under a magnetic field to obtain a compact in a predetermined shape;
(4) sintering this compact at a high temperature (e.g., about 1,000° C. or more) to obtain a sintered magnet;
(5) further subjecting the resultant sintered magnet to a heat treatment called an "aging treatment" to improve the magnetic properties thereof; and
(6) grinding the surface of the sintered magnet to adjust the sizes and shapes thereof.

In compacting an alloy (or magnet) powder material for use to produce the magnet described above, the orientation directions of the alloy particles need to be aligned with a predetermined direction under a magnetic field. It is known that a rare earth sintered magnet with excellent magnetic properties can be obtained by using an alloy powder that has been prepared by a strip casting process. However, it is particularly difficult to obtain a compact of quality from this alloy powder. This is because the alloy powder obtained by a strip casting process or any other rapid cooling process has a small mean particle size (e.g., about 2 μm to about 5 μm), a narrow particle size distribution and a low flowability (or compactability). It should be noted that the "mean particle size" means herein a mass median diameter unless stated otherwise.

To produce a rare earth sintered magnet with excellent magnetic properties, the present inventors tested various conventional powder compacting methods to discover that those methods had the following problem. This problem will be described with reference to FIGS. 13(*b*) and 13(*c*). It should be noted that the feature of an inventive powder compacting method as shown in FIG. 13(*a*) will be described later.

Suppose an alloy powder material, prepared by a strip casting process, is loaded into a cavity and pressed by an upper punch and a lower punch (typically made of a metal (e.g., SUS 304)) in accordance with a normal uniaxial compacting method (typically a die-pressing method). In that case, if the alloy powder material 10 has a fill density (or loading weight) distribution as shown in FIG. 13(*b*) (where H indicates a high density and L indicates a low density), then the resultant compact 20 should also have a non-uniform density distribution corresponding to the fill density distribution. Also, even if the cavity is filled with the alloy powder material at a sufficiently uniform density, the alloy powder material may still show some variation in its fill density when subjected to a magnetic field alignment process during the pressing process. Such a variation is caused by the field strength (or flux density) distribution during the magnetic field alignment process. A higher pressure is normally applied to a portion with a higher fill density. Accordingly, when the alloy powder material is subjected to the pressing process, such a variation in its density is amplified. And if such a density variation is significant, then the compact may crack, chip or deform as a result.

Furthermore, when the compact 20 with such a non-uniform density distribution is sintered, the resultant sintered body 30 should be further deformed. This is because there is a correlation between the rate of shrinkage of the compact 20 through the sintering process and the density of the compact 20. That is to say, the shrinkage rate changes with the density distribution. This problem is particularly noticeable in a compact with a low density. Also, a thin compact is considerably affected by the distribution in the shrinkage rate, easily cracks or chips, and is likely deformed significantly.

On the other hand, it is known that a quality compact of a magnetic powder material can be obtained by a rubber pressing method. In this method, a magnetic powder material is loaded into a mold made of rubber and then immersed in a liquid medium such that a hydrostatic pressure is applied to the magnetic powder material by way of the rubber mold. According to this rubber pressing method, a pressure can be applied isotropically to the magnetic powder material. Thus, even if the magnetic powder material that has been loaded into the mold has a non-uniform density distribution, a compact with a uniform density distribution can still be obtained. Unfortunately, though, the rubber pressing method is a sort of hydrostatic pressure pressing process with very low productivity and is hard to apply industrially.

Thus, to increase the low productivity of the rubber pressing process, Japanese Patent Gazette for Opposition No. 55-26601 proposes a parallel die-pressing method in which a pre-molded rubber container is put into a die, filled with an alloy powder, and then pressure is applied thereto in the same direction as the magnetic field. In the pressing method disclosed in Japanese Patent Gazette for Opposition No. 55-26601, however, if a powder material with a low fill density, which has been loaded by a natural loading technique, for example, is pressed, then the resultant compact likely cracks, chips or deforms.

To overcome such a problem, Japanese Laid-Open Publication No. 4-363010 proposes a method of die-pressing a magnetic powder material that has been loaded into a mold, having at least a rubber side surface and a bottom, at a high density (which is at least 1.2 times as high as the natural fill density). According to this method, however, the magnetic powder material 10 likely has a non-uniform fill density distribution while being loaded into such a rubber mold at a high density. Thus, the resultant compact 20 can have a uniform compact density as shown in FIG. 13(*c*). But since the outer shape of the compact 20 reflects its fill density distribution, it is difficult to obtain a compact in a predetermined shape. For that reason, to process a sintered body 30, obtained from such a compact 20, into the predetermined shape, all of the surfaces of the sintered body 30 must be machined. Also, this method requires high-density filling. Accordingly, when a magnetic powder with a small mean particle size and a narrow particle size distribution (e.g., a rare earth alloy powder obtained by a strip casting process) is used, the powder easily sticks together, thus causing a significant variation in fill density. As a result, the problem becomes even more noticeable.

As described above, none of the conventional techniques can compact a powder material with a non-uniform fill density distribution at a high productivity with cracking, chipping or deformation of the compact minimized. In particular, none of those techniques can compact a powder material with a low fill density (e.g., the rare earth alloy powder material described above) at a high productivity.

In order to overcome the problems described above, an object of the present invention is to provide a powder compacting method and apparatus that can make a compact with a uniform density distribution at a high productivity even from a powder material with a non-uniform fill density distribution, and a method for producing a magnet by using them.

DISCLOSURE OF INVENTION

A powder compacting method according to the present invention includes the steps of: providing a powder material; loading the powder material into a cavity; uniaxially pressing the powder material, which has been loaded into the cavity, between two opposed press surfaces, thereby obtaining a compact, wherein at least one of the two press surfaces is deformed elastically under a compacting pressure when contacting with the powder material in the cavity; and unloading the compact from the cavity.

In one preferred embodiment, the at least one press surface is the surface of a resin layer.

In another preferred embodiment, the resin layer has a Shore A hardness of 25 to 95.

In another preferred embodiment, in the uniaxially pressing step, just one of the two press surfaces is deformed elastically under the compacting pressure.

In another preferred embodiment, the loading step includes the step of measuring the powder material with the cavity.

In another preferred embodiment, the loading step includes the step of filling the cavity with the powder material at a relative density of 0.20 to 0.35.

In another preferred embodiment, the uniaxially pressing step includes the step of uniaxially pressing the powder material to a volume that is 0.5 to 0.65 time as large as the content volume of the cavity.

In another preferred embodiment, the compact satisfies $D \leqq |S^{1/2}|/3$, where D is the thickness (mm) of the compact as measured in a press axis direction in the uniaxially pressing step and S is the area ($mm^2$) of each of the two press surfaces.

An inventive method for producing a magnet includes the steps of: providing a powder material including a rare earth alloy powder; loading the powder material into a cavity; uniaxially pressing the powder material, which has been loaded into the cavity, between two opposed press surfaces, thereby obtaining a compact, wherein at least one of the two press surfaces is deformed elastically under a compacting pressure when contacting with the powder material in the cavity; and unloading the compact from the cavity.

In one preferred embodiment, the at least one press surface is the surface of a resin layer.

In another preferred embodiment, the resin layer has a Shore A hardness of 25 to 90.

In another preferred embodiment, in the uniaxially pressing step, just one of the two press surfaces is deformed elastically under the compacting pressure.

In another preferred embodiment, the loading step includes the step of measuring the powder material with the cavity.

In another preferred embodiment, the loading step includes the step of filling the cavity with the powder material at a relative density of 0.20 to 0.35.

In another preferred embodiment, the uniaxially pressing step includes the step of uniaxially pressing the powder material to a volume that is 0.5 to 0.65 time as large as the content volume of the cavity.

In another preferred embodiment, the compact satisfies $D \leqq |S^{1/2}|/3$, where D is the thickness (mm) of the compact as measured in a press axis direction in the uniaxially pressing step and S is the area ($mm^2$) of each of the two press surfaces.

In another preferred embodiment, the method further includes the step of aligning the rare earth alloy powder by applying a magnetic field thereto perpendicularly to the press axis direction during the uniaxially pressing step.

In another preferred embodiment, in the uniaxially pressing step, the press axis direction is defined vertically, the two press surfaces consist of an upper press surface and a lower press surface, the side surface of the cavity is defined by an inner surface of a die, and the bottom of the cavity is defined by the lower press surface.

In another preferred embodiment, the method further includes the steps of: sintering the compact to obtain a sintered body; and finishing the surface of the sintered body. The surface finishing step includes the step of selectively grinding only a surface of the sintered body that contacted with the at least one press surface in the uniaxially pressing step.

A powder compacting apparatus according to the present invention is provided to uniaxially press a powder material that has been loaded into a cavity. The apparatus includes: a die having an inner surface that defines the side surface of the cavity; a lower punch having a lower press surface that defines the bottom of the cavity; and an upper punch having an upper press surface that is opposed to the lower press surface. In uniaxially pressing the powder material, which has been loaded into the cavity, between the lower and upper press surfaces, at least one of the lower and upper press surfaces is selectively deformed elastically under a compacting pressure among the inner surface, the lower press surface and the upper press surface that define the cavity.

In one preferred embodiment, the at least one press surface is the surface of a resin layer.

In another preferred embodiment, the resin layer has a Shore A hardness of 25 to 90.

In another preferred embodiment, just one of the lower and upper press surfaces is deformed elastically under the compacting pressure.

In another preferred embodiment, the upper press surface is deformed elastically under the compacting pressure.

In another preferred embodiment, the upper press surface is the surface of a resin layer, and the upper punch includes a member for preventing the resin layer from expanding in a horizontal direction, which is perpendicular to the press axis direction, under the compacting pressure.

In another preferred embodiment, the upper punch includes a concave portion to receive the resin layer, and the side surface of the concave portion prevents the resin layer from expanding in the horizontal direction that is perpendicular to the press axis direction under the compacting pressure.

In another preferred embodiment, the upper punch includes a resin layer, a portion of which changes its hardness in the press axis direction, and the upper press surface is the surface of the resin layer.

In another preferred embodiment, the resin layer includes: a first resin layer with a first hardness; and a second resin layer with a second hardness that is lower than the first hardness, and the upper press surface is the surface of the first resin layer.

BRIEF DESCRIPTION OF DRAWINGS

FIG. 2 schematically illustrates a cross-sectional structure of a compacting apparatus 100 according to the present invention, wherein: FIG. 2(*a*) illustrates a state in which a powder material 10 has just been loaded into a cavity; FIG. 2(*b*) illustrates a state in which a compacting pressure is applied thereto; and FIG. 2(*c*) illustrates a state in which a compact 20 is unloaded.

FIG. 6 schematically illustrates another upper punch 505 for use in a powder compacting apparatus according to the present invention, wherein: FIG. 6(*a*) is a cross-sectional view thereof; and FIG. 6(*b*) is a plan view thereof.

FIG. 10(*b*) is a schematic representation showing a method for estimating a size variation.

FIG. 11(*b*) shows the outer peripheral shape of a sintered body, which was obtained by using an upper punch with no resin layer.

FIGS. 13(*a*), 13(*b*) and 13(*c*) illustrate the features of various powder compacting methods, wherein:

FIG. 13(*b*) shows a method that uses a normal die; and

FIG. 13(*c*) shows a rubber molding method.

FIG. 13(*c*) shows a method that uses a normal die.

BEST MODE FOR CARRYING OUT THE INVENTION

Hereinafter, embodiments of a powder compacting method and apparatus according to the present invention will be described with reference to the accompanying drawings.

Figure 1:
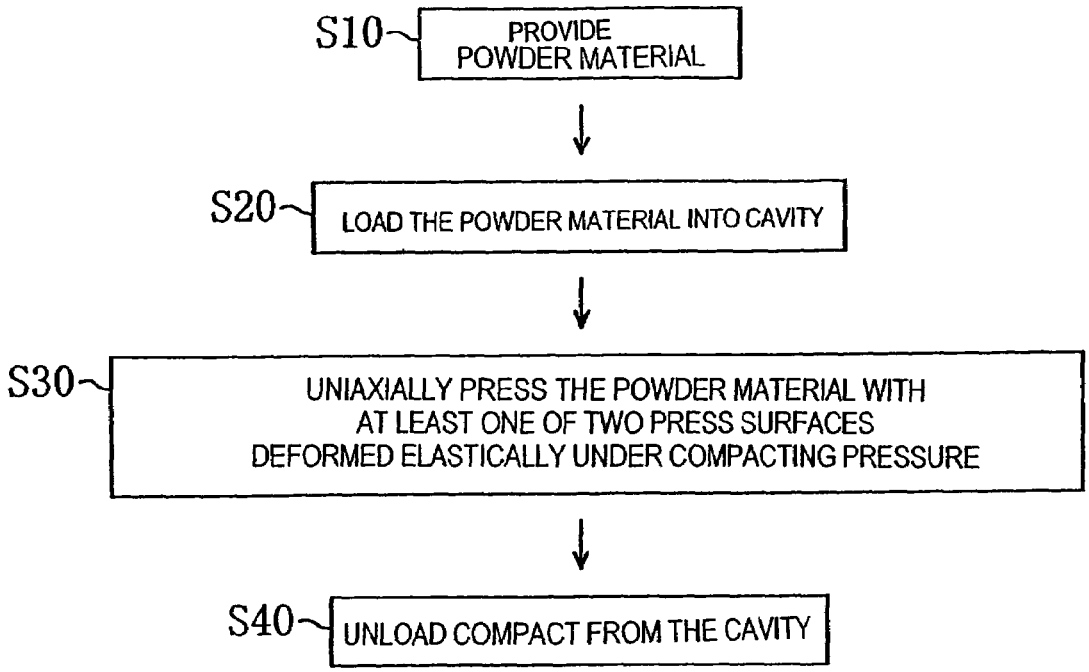
FIG. 1 is a flowchart showing a powder compacting method according to the present invention.

As shown in the flowchart of FIG. 1, a powder compacting method according to an embodiment of the present invention includes: the step S10 of providing a powder material; the step S20 of loading the powder material into a cavity; the step S30 of uniaxially pressing the powder material with at least one of two press surfaces deformed elastically under a compacting pressure; and the step S40 of unloading a compact from the cavity. In the uniaxially pressing step S30, at least one of two opposed press surfaces, contacting with the powder material in the cavity, is deformed elastically under the compacting pressure.

Figure 13A:
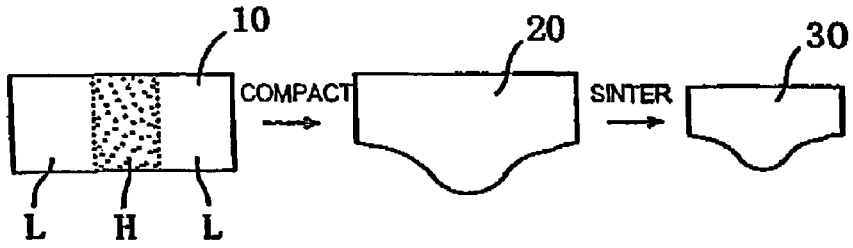
Figure 13B:
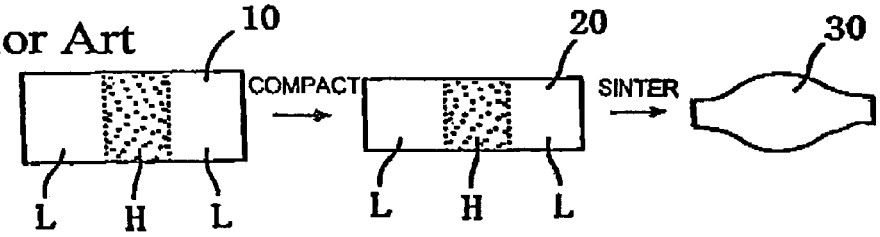
FIG.13(b) Prior Art
Figure 13C:
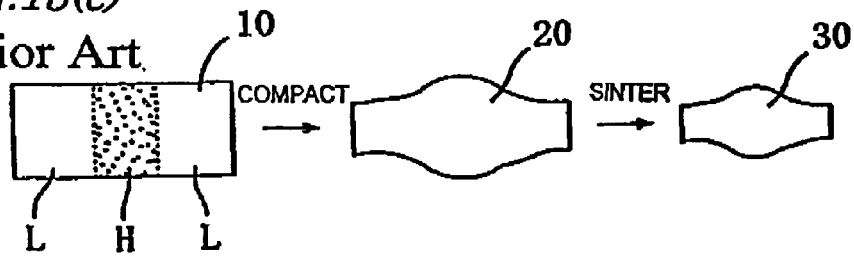
FIG.13(c) Prior Art

That is to say, in the powder compacting method of the present invention, at least one of the two press surfaces (i.e., both or one of the two press surfaces) is deformed elastically under the compacting pressure, whereas at least the side surface of the cavity is not deformed elastically under the compacting pressure but substantially maintains its original shape during the pressing process. Even if the powder material in the cavity has a non-uniform fill density distribution, the non-uniform fill density distribution is counterbalanced with the elastic deformation of the at least one press surface, thereby applying a uniform pressure to the powder material. For example, as shown in FIG. 13(*a*), portions of the compact 20 corresponding to low-fill-density portions of the powder material 10 (i.e., as indicated by L in FIGS. 13(*a*) through 13(*c*)) are thinner than the other portion of the compact 20 corresponding to a high-fill-density portion of the powder material 10 (as indicated by H in FIGS. 13(*a*) through 13(*c*)) as measured in a press axis direction (i.e., perpendicularly to the press surfaces). That is to say, the non-uniform fill density distribution is transformed into a non-uniform thickness distribution of the compact 20, thus uniformizing the density of the compact 20. According to the powder pressing method of the present invention, even a rare earth alloy powder, having a fill density that is low enough to have its orientation directions aligned under a magnetic field sufficiently, can be pressed into a compact with a uniform density distribution at a high productivity.

Furthermore, the surface to counterbalance the non-uniform fill density distribution is just the surface that has been in contact with the elastically deformed press surface. Thus, at most two opposed surfaces should counterbalance that non-uniform fill density distribution. Accordingly, when just one of the two press surfaces is supposed to be elastically deformed, just one surface of the compact 20 has counterbalanced the non-uniform fill density distribution and the other surface of the compact 20 (i.e., the surface that has been in contact with the non-elastically-deformed press surface) has a predetermined shape (typically a flat shape) as shown in FIG. 13(*a*). This is because the other surface is defined by the side surface of the cavity and the other press surface that are substantially not deformed elastically under the compacting pressure.

As described above, the compact 20 obtained by the powder compacting method of the present invention has a uniform density distribution, and therefore, hardly chips, cracks, or deforms. Furthermore, the compact 20 shrinks uniformly even during the sintering process, thus creating almost no chipping, cracking or deformation in the sintered body 30. Thus, high-quality compacts can be obtained at a high productivity. In addition, the powder pressing method of the present invention can also process a powder material with a relatively low fill density. Thus, the method of the present invention can be used effectively to prepare a compact to be processed into a rare earth sintered magnet.

Furthermore, even though the compact shrinks through the sintering process, the compact can still maintain a predetermined outer shape as defined by the side surface of the cavity. Accordingly, it is just the surface of the compact, which has been in contact with the elastically deformed press surface, that needs to be processed (e.g., grinded) by a subsequent finishing process. Thus, even in a situation where both of the two press surfaces are supposed to be deformed elastically, only the two opposed surfaces of the compact should be processed, but the side surface of the compact does not have to be processed. For example, if a compact with six sides is obtained by a conventional compacting method, all of those six sides need to be processed. In contrast, according to the powder compacting method of the present invention, at most two sides need to be processed, thus increasing the throughput significantly. Furthermore, the processing margin (or grinding margin) can be decreased, thus increasing the yield of the material, too. In particular, in the situation where just one of the two press surfaces is supposed to be deformed elastically as shown in FIG. 13(*a*), only one surface needs to be subjected to the finishing process. As a result, the productivity can be further increased.

Figure 2A:
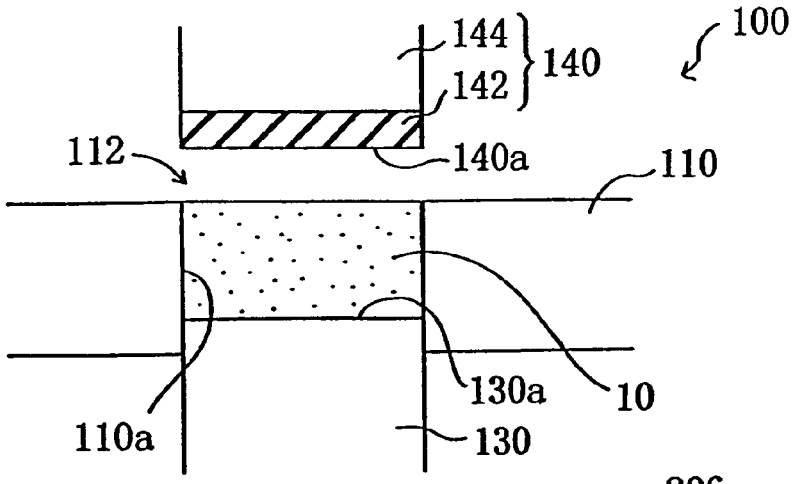
Figure 2B:
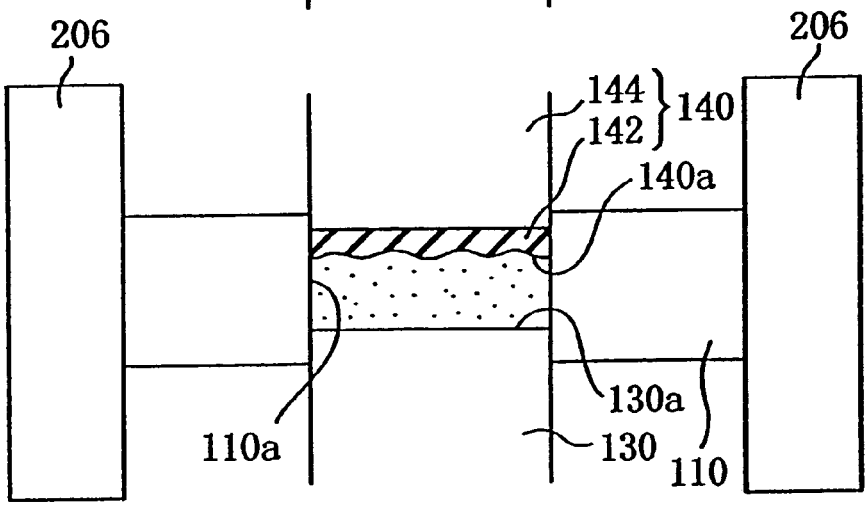
Figure 2C:
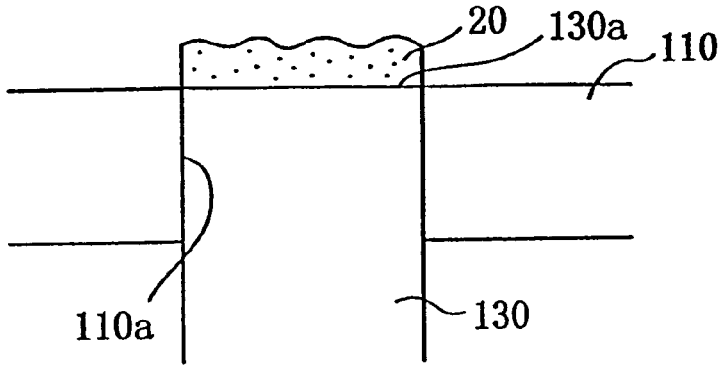

The powder compacting method described above may be carried out with the powder compacting apparatus 100 shown in FIG. 2, for example. FIGS. 2(*a*), 2(*b*) and 2(*c*) schematically illustrate a cross-sectional structure of the compacting apparatus 100. FIG. 2(*a*) illustrates a state in which a powder material 10 has just been loaded into a cavity 112; FIG. 2(*b*) illustrates a state in which a compacting pressure is applied thereto; and FIG. 2(*c*) illustrates a state in which a compact 20 is unloaded.

The powder compacting apparatus 100 includes: a die 110 with an inner surface 110*a* that defines the side surface of the cavity 112; a lower punch 130 with a lower press surface 130*a* that defines the bottom of the cavity 112; and an upper punch 140 with an upper press surface 140*a* that is opposed to the lower press surface 130*a*. If necessary, the powder compacting apparatus 100 may further include a magnetic field generating coil 206 to align the particles of a rare earth alloy powder, for example, under a magnetic field during the pressing process.

In this powder compacting apparatus 100, only the upper press surface 140*a*, not the inner surface 110*a* or the lower press surface 130*a*, is deformed elastically under a compacting pressure while the powder material 10 is being pressed uniaxially. The lower and upper punches 130 and 140 can be freely inserted into, and removed from, the opening 112 of the die 110 with a predetermined clearance allowed with respect to the inner surface 110*a*. The opening and the cavity are identified herein by the same reference numeral.

In the following example, only the upper press surface 140*a* is deformed elastically. Naturally, only the lower press surface 130*a* may be deformed elastically. Alternatively, both the lower and upper press surfaces 130*a* and 140*a* may be deformed elastically. However, just one of the lower and upper press surfaces 130*a* and 140*a* is preferably deformed elastically because the subsequent finishing process can be simplified in that case. That is to say, to obtain a compact in a predetermined shape by the subsequent surface finishing process, one of the two surfaces may be used as a reference plane for the surface finish and only the other surface may be processed (e.g., grinded).

The powder compacting apparatus 100 may be the same as a known die-pressing apparatus except that just the upper press surface 140*a* is selectively deformed elastically under a compacting pressure to be applied in the uniaxial pressing process among the surfaces that define the cavity 112 and the upper press surface 140*a* (i.e., the surfaces that contact with the powder material during the pressing process). The die 110, the lower punch 130 and the base 144 of the upper punch 140 may be made of a metal (e.g., SUS 304). Also, the die 110 and the lower and upper punches 130 and 140 may be driven hydraulically.

The press surface 140*a* to be deformed elastically under the compacting pressure may be formed by providing a pressure medium layer 142 having an appropriate mechanical property (which is well represented by its Shore hardness) on the surface of the metallic base 144. The pressure medium layer 142 does not always have to be a solid but may also be a liquid which is hermetically packed in an appropriate bag. Nevertheless, it is still convenient to use a solid layer. For example, a resin layer is preferably used as the pressure medium layer 142. A resin having a Shore A hardness of 25 to 90 is preferably used as a material for the resin layer. A resin layer with a Shore A hardness of 60 to 85 is particularly preferred. Specifically, the resin layer is preferably made of a urethane resin including urethane rubber.

Hereinafter, the operation of the powder compacting apparatus 100 and the powder compacting method of the present invention will be described with reference to FIGS. 2(*a*) through 2(*c*).

First, as shown in FIG. 2(*a*), the powder material 10 is loaded into the cavity 112. The powder may be loaded by any of various known methods. However, the powder compacting apparatus and method of the present invention can be used effectively to compact the powder material 10 that has been loaded there at a low fill density (or to form a thin compact among other things). Thus, a loading method to be preferably adopted for that purpose will be described. The powder material to be used is not particularly limited. This is because according to the powder compacting method of the present invention, a quality compact can be obtained even from a powder material with particularly poor flowability (i.e., loadability and/or compactability).

A material including the rare earth alloy powder (e.g., an R—Fe—B based alloy powder) prepared by the strip casting process mentioned above may be used as the powder material. To increase the flowability (i.e., loadability and compactability), a powder material, in which a lubricant has been added in a predetermined amount (e.g., at most 0.12 wt % of aliphatic ester) to the surface of a rare earth alloy powder with a predetermined particle size (of 2 μm to 6 μm, for example), is typically used. Optionally, it is not impossible to use a material obtained by granulating a rare earth alloy powder with a lubricant or a binder. However, such a material is not preferred because a higher magnetic field is needed to decompose the granulated particles into primary particles and thereby align those rare earth alloy powder particles under a magnetic field. Also, if carbon, included in the lubricant or binder to be added to the rare earth alloy powder, is left in the sintered body, then that carbon may deteriorate the magnetic properties. For that reason, the amount of those additives is preferably as small as possible, generally speaking. It is one of the reasons why a rare earth alloy powder is hard to compact into a desired shape that the amount of the additive such as the lubricant is limited in this manner.

The process step of loading the powder material may be carried out by using either a sieve or a feeder box as disclosed in Japanese Patent Publication for Opposition No. 59-40560, Japanese Laid-Open Publication No. 10-58198, Japanese Utility Model Publication No. 63-110521 and Japanese Laid-Open Publication No. 2000-248301. By adopting such a loading technique, the powder can be loaded at a fill density that is low enough to have its orientation directions aligned under the magnetic field.

Particularly when a powder material with poor flowability (or fill density) such as a rare earth alloy powder prepared by a strip casting process should be loaded, the method disclosed in Japanese Laid-Open Publication No. 2000-248301, which was filed by the applicant of the present application, is preferably used. In that method, a feeder box with an opening at the bottom is positioned over a cavity and a bar member is horizontally reciprocated on the bottom of the feeder box, thereby feeding an alloy powder material from the feeder box into the cavity. In this manner, the alloy powder can be loaded from the feeder box into the cavity sequentially (i.e., beginning with a part of the powder near the bottom) at an equal pressure. As a result, the cavity can be filled with the powder at a relatively uniform density without causing any lumps or bridges.

To obtain a thin compact, a powder material in an amount corresponding to the inner volume of the cavity is preferably measured with the cavity in the loading process step. For example, if the bar member is reciprocated over the cavity as in the method described above, then the cavity can be filled with the powder material that has been fed thereto with the excessive portion thereof sliced off. Thus, the cavity can be filled with the predetermined amount of powder material relatively uniformly. It should be noted that if the powder material is loaded by such a method, then a non-uniform loading weight (or fill density) distribution is likely formed on the surface of the powder material loaded (i.e., on the upper surface of the cavity) in the direction in which the bar member is going back and forth. Accordingly, if such a powder material is uniaxially pressed by using a conventional die-pressing apparatus in which no press surfaces are deformed elastically under the compacting pressure, then the resultant compact should have a non-uniform density distribution and may chip, crack or deform. However, according to the powder pressing method of the present invention, a compact with a uniform density distribution can be obtained. In forming a thin compact, in particular, the non-uniform fill density distribution near the surface of the powder material should have significant effects. Thus, the present invention is particularly effective in such a situation.

According to any of the various loading techniques described above, the powder material can be loaded into the cavity at a relative density of 0.20 to 0.35. As used herein, the "relative density" means the ratio of the fill density of the powder material to the true density thereof. If the powder material is measured with the cavity, the fill density thereof is given by dividing the mass of the powder material in the cavity by the inner volume of the cavity. The powder material that has been loaded at such a relative density can have its orientation directions sufficiently aligned under a magnetic field even if the powder material is a rare earth alloy powder prepared by a strip casting process.

Next, as shown in FIG. 2(*b*), by lowering the upper punch 140, for example, the powder material 10 that has been loaded into the cavity 112 is uniaxially pressed between the lower and upper press surfaces 130*a* and 140*a*. The powder material that has been loaded typically at a relative density of 0.20 to 0.35 is uniaxially pressed in this uniaxial pressing step. As a result, a compact having a relative density (i.e., the ratio of the green density of the compact to the true density thereof) of 0.5 to 0.7 can be obtained. The compacting pressure may be in the range of 50 kgf/cm$^2$ to 5,000 kgf/cm$^2$ (i.e., in the range of 4.9 MPa to 490 MPa). For example, if a rare earth alloy powder (e.g., an R—Fe—B based alloy powder) prepared by a strip casting process is used, then the compacting pressure preferably falls within the range of 500 kgf/cm$^2$ to 1,000 kgf/cm$^2$ (i.e., the range of 49 MPa to 98 MPa). In that case, a compact, of which the density is about 52% to about 62% of the true density, can be obtained.

Optionally, before the uniaxial pressing process is started, a lubricant (which may be the same as that applied to the surface of the rare earth alloy powder) may be sprayed onto the powder material 10 in the cavity 112 and onto the surface of the upper punch 140. A urethane resin is particularly preferred as a material for the resin layer 142 because the urethane resin exhibits an appropriate Shore hardness, excellent abrasion resistance and good resistance to the lubricant.

In this uniaxial pressing process, the upper press surface 140*a*, which may be the surface of the resin layer 142, for example, is elastically deformed due to a non-uniform pressure distribution resulting from the non-uniform fill density distribution of the powder material 10. On the other hand, the lower press surface 130*a* and the inner surface 110*a* of the opening 112 of the die 110, which may be made of SUS, for example, are not elastically deformed substantially under the compacting pressure even though those surfaces contact with the powder material 10. Accordingly, the bottom and the side surface of the powder material 10 being compacted maintain their predetermined shapes. But just its surface in contact with the upper press surface 140*a* is deformed in such a manner as to counterbalance the non-uniform density distribution. Consequently, the resultant compact 20 has a uniform density distribution and chipping, cracking or deformation thereof can be minimized.

In particular, even if the resultant compact is thin enough to satisfy $D \leqq |S^{1/2}|/3$ (where D is the thickness (mm) of the compact as measured in the press axis direction and S is the area (mm$^2$) of each press surface), chipping or cracking thereof can still be reduced sufficiently. The thickness of the resin layer 142 is preferably at most twice greater than the thickness D (mm) of the compact. The thickness of the resin layer 142 should not be more than twice greater than the thickness D (mm) of the compact because the pressure cannot be transmitted efficiently in that case. The thickness of the resin layer 142 is not particularly limited as long as the resin layer 142 can counterbalance the non-uniform fill density distribution. However, the thickness of the resin layer 142 is at least one-third of the thickness D (mm) of the compact. This is because an excessively thin resin layer 142 may not function as a pressure medium effectively enough.

It should be noted that to align the rare earth alloy powder particles under a magnetic field, the magnetic field is applied externally during the uniaxial pressing process. For example, a magnetic field of about 0.8 MA/m to about 1.3 MA/m may be applied perpendicularly to the uniaxial pressing direction. On the application of such a high aligning magnetic field, if the die used has lower saturation magnetization than the powder loaded, then the powder is attracted toward both ends of the cavity in the aligning direction (i.e., the side surface thereof) during the aligning process. In this manner, the fill density of the powder may further vary upon the application of the aligning magnetic field. Even so, a compact having a uniform density can also be obtained according to the present invention.

Next, the resultant compact 20 is unloaded from the cavity. This process step may be carried out by any of various known techniques. However, a compact with a relatively low density (of which the green density is 50% to 70% of the true density thereof), made of a material with poor flowability such as a rare earth alloy powder material prepared by a strip casting process, is brittle. Accordingly, such a compact is preferably unloaded from the cavity 112 by a hold-down technique, in which the die 110 is lowered with a certain pressure (e.g., about 1% to about 20% of the compacting pressure) maintained between the upper and lower press surfaces 130*a* and 140*a* such that the surface of the compact 20 that has been in contact with the inner surface 110*a* of the opening 112 is exposed as shown in FIG. 2(*c*). In that case, only the upper press surface 140*a* is preferably deformed elastically. This is because if the press surface to be deformed elastically is the surface of the resin layer, the surface of the resin layer will not adhere so closely to the compact as the surface of the metal. Thus, it is possible to avoid a situation where the compact adheres so strongly to the resin layer as to be lifted by the resin layer over the die. That is to say, the compact will not drop and chip or crack. Also, if the lower press surface 130*a* is deformed elastically, then the bottom of the compact 20 will have some unevenness. In that case, portions of the bottom of the compact 20 will be located at a lower level than the upper surface of the die 110. Thus, the compact 20 easily chips or cracks while being unloaded from the cavity 112.

Also, if the upper press surface 140*a* is defined by the surface of the resin layer 142, the resin layer 142 that has left the cavity 112 is also expanded under the compacting pressure in a horizontal direction that is perpendicular to the press axis direction. Due to this deformation of the resin layer 142, the compact 20 may chip or crack around its periphery. To minimize such chipping or cracking, a member to prevent the resin layer 142 from being expanded in the horizontal direction (i.e., perpendicularly to the press axis direction) is preferably provided. For example, the resin layer 142 is preferably fitted in a concave portion, which is provided in the base 144, such that the deformation of the surface of the resin layer 142 (corresponding to the press surface 140*a*) in the direction perpendicular to the press axis direction is minimized by the wall of the concave portion. Instead, the resin layer 142 is preferably allowed to be deformed only in the press axis direction inside of the concave portion.

Hereinafter, an embodiment of a method for producing a sintered magnet of an R—Fe—B based alloy powder, prepared by a strip casting process, will be described.

First, an alloy flake, having a composition including 30 wt % of Nd, 1.0 wt % of B, 1.2 wt % of Dy, 0.2 wt % of Al, 0.9 wt % of Co, and Fe and inevitable impurities as the balance, is prepared by a strip casting process (see U.S. Pat. No. 5,383,978, for example). More specifically, an alloy that has been prepared by a known method so as to have a composition including 30 wt % of Nd, 1.0 wt % of B, 1.2 wt % of Dy, 0.2 wt % of Al, 0.9 wt % of Co, and Fe and inevitable impurities as the balance is melted by a high-frequency melting process to obtain a melt. As the rare earth alloy, not only an alloy having such a composition but also an alloy having the composition disclosed in U.S. Pat. No. 4,770,723 or 4,792,368 may be used effectively.

The melt of this rare earth alloy is heated to, and maintained at, 1350° C. and then rapidly cooled on a single roller at a peripheral velocity of about 1 m/sec, a cooling rate of 500° C./min and a supercooling rate of 200° C., thereby obtaining an alloy flake with a thickness of 0.3 mm. This alloy flake is embrittled by being subjected to a hydrogen occlusion process to obtain an alloy coarse powder. Then, the alloy coarse powder is finely pulverized by a jet mill machine within a nitrogen gas atmosphere, thereby obtaining an alloy powder with a mean particle size of 3.5 μm. This alloy powder has a true density of 7.5 g/cm$^3$. This fine pulverization process is preferably carried out by the apparatus and method disclosed in Japanese Patent Application No. 11-62848. The finely pulverized powder of the alloy, prepared by a rapid cooling process such as a strip casting process (at a cooling rate of $10^2$ to $10^{4o}$ C./sec) in this manner, has a narrow particle size distribution and exhibits poor compactability but can still be used effectively as a material for a magnet exhibiting good magnetic properties.

Next, to improve the flowability (i.e., loadability and/or compactability) of the alloy powder obtained in this manner, the surface of the alloy powder is coated with a lubricant. For example, aliphatic ester may be used as the lubricant and diluted with a petroleum solvent. The mixture may be added at 0.5 wt % to 5.0 wt % (on the lubricant basis) to the resultant alloy powder in a rocking mixer, thereby coating the surface of the alloy powder with the lubricant. Methyl caproate may be used as the aliphatic ester and isoparaffin may be used as the petroleum solvent. The weight ratio of methyl caproate to isoparaffin may be 1:9.

However, the lubricant is not limited to any particular type. For example, any aliphatic ester diluted with any solvent may be used. Examples of preferred aliphatic esters include not just methyl caproate but also methyl caprylate, methyl laurate and methyl laurylate. As the solvent, petroleum solvents such as isoparaffin and naphthene solvents may be used. The aliphatic ester and the solvent may be mixed at a weight ratio of 1:20 to 1:1. Instead of, or in addition to, the liquid lubricant, a solid lubricant such as zinc stearate may also be used. When a liquid lubricant is used, no solvent may be used.

The weight of the lubricant to be added may be determined appropriately. However, to improve the compactability and magnetic properties, the powder material to be compacted preferably includes no greater than 0.12 wt % of lubricant to the overall weight of the alloy powder.

Figure 3A:
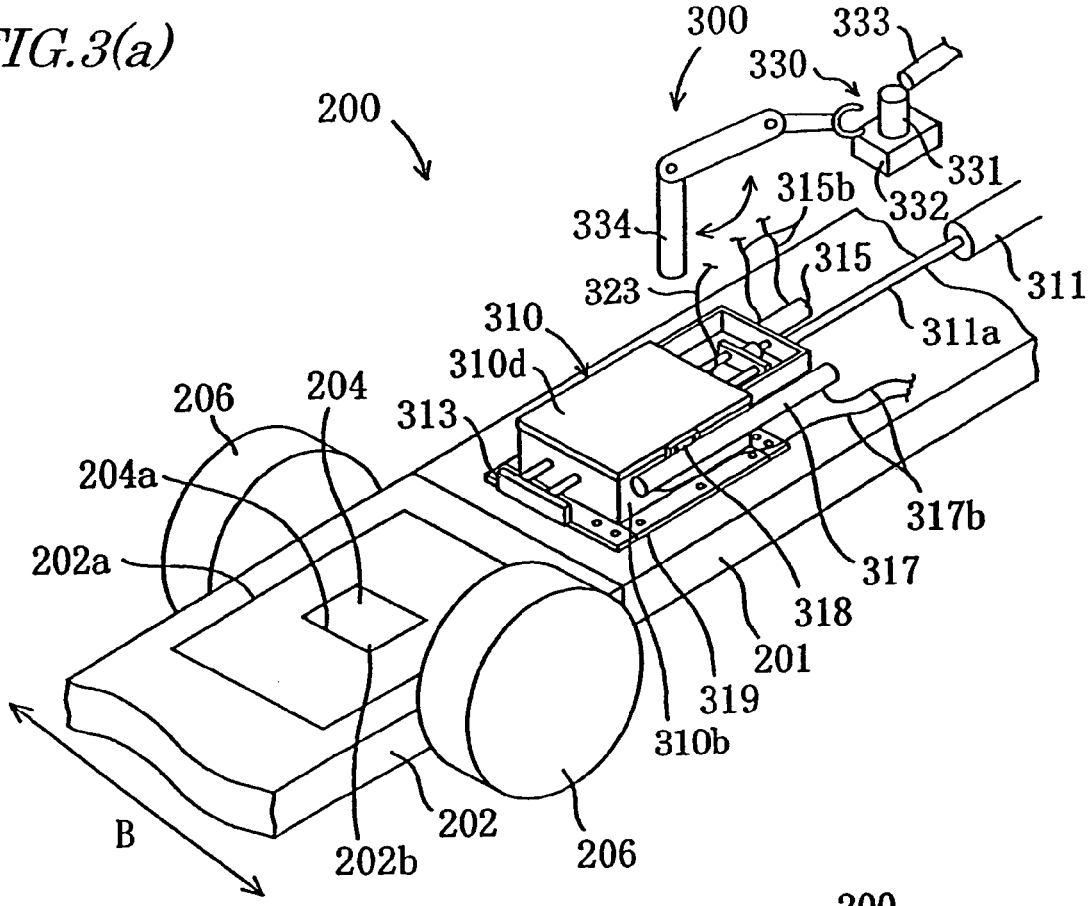
FIG. 3(*a*) is a perspective view schematically illustrating a powder compacting apparatus 200 according to an embodiment of the present invention, and FIG. 3(*b*) is a schematic cross-sectional view of the powder compacting apparatus 200.
Figure 3B:
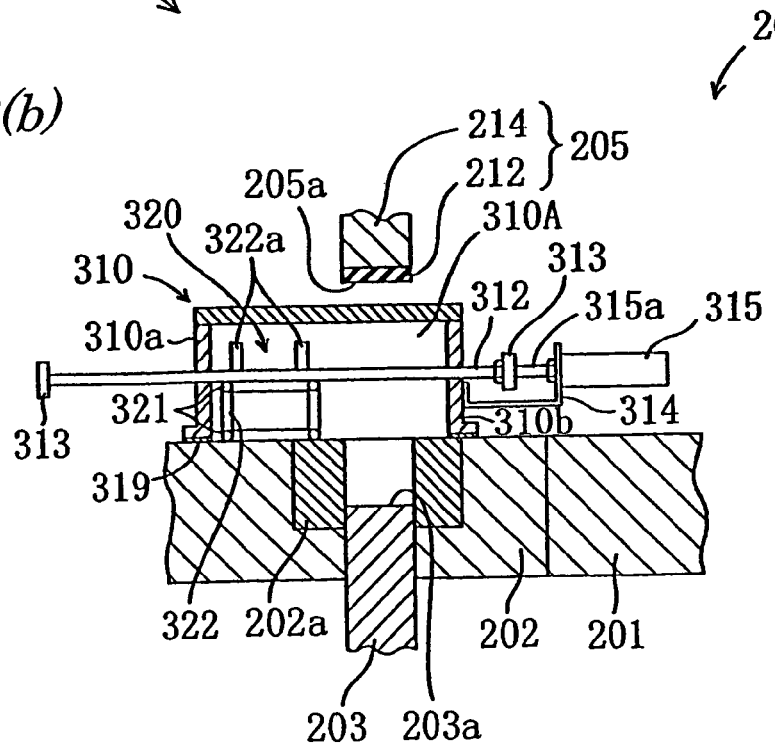

Next, a uniaxial pressing process is carried out using a powder compacting apparatus 200 according to an embodiment of the present invention as shown in FIGS. 3(*a*) and 3(*b*). FIG. 3(*a*) is a schematic perspective view of the powder compacting apparatus 200 and FIG. 3(*b*) is a schematic cross-sectional view of the powder compacting apparatus 200.

The powder compacting apparatus 200 includes a powder material feeding mechanism 300. A die set 202 is disposed adjacent to a base plate 201. A die 202*a* is fitted in the die set 202 and is provided with an opening (die hole) 202*b* that runs through the die 202*a* vertically. A lower punch 203 is provided under this die hole 202*b* so as to freely go up and down inside the die hole 202*b*. A cavity 204 having an arbitrary inner volume is defined by the inner surface 204*a* of this die hole 202*b* and the press surface 203*a* of the lower punch 203. In the illustrated example, a thin rectangular cavity 204 is defined. The cavity 204 may have a longer-side length of 80 mm, a shorter-side length of 52.2 mm and a depth of 16 mm, for example.

After an alloy powder has been fed into the cavity 204 by using the powder material feeding mechanism 300, an upper punch 205 is introduced into the cavity 204, and the alloy powder material is uniaxially pressed between the press surface 205*a* of the upper punch 205 and the press surface 203*a* of the lower punch 203, thereby forming a compact of the alloy powder material. A pair of magnetic field generating coils 206 is provided on both sides of the die 202*a* to apply a magnetic field perpendicularly to the uniaxial pressing direction and parallelly to the longer-side direction of the cavity 204 as indicated by the arrow B in FIG. 3(*a*).

The die 202*a*, the lower punch 203 and the base 214 of the upper punch 205 are made of a stainless steel (e.g., SUS 304). The resin layer 212 of the upper punch 205 is made of a urethane resin with a Shore A hardness of 75 to 80. As already described with reference to FIGS. 2(*a*) through 2(*c*), this resin layer 212 is deformed elastically under a compacting pressure in accordance with the fill density distribution, thereby obtaining a compact with a uniform density.

In this example, the loading technique that uses the powder material feeding mechanism 300 disclosed in Japanese Laid-Open Publication No. 2000-248301 is used. However, the present invention is in no way limited to this loading technique, but the powder material may be loaded by any of various other methods.

The powder material feeding mechanism 300 includes a feeder box 310 on the base plate 201. This feeder box 310 is driven by the cylinder rod 311*a* of an air cylinder 311 so as to go back and forth between a position over the die 202*a* and a standby position. A supplier 330 for supplying the feeder box 310 with the rare earth alloy powder is provided near the standby position of the feeder box 310.

A feeder cup 331 is placed on the balance 332 of the supplier 330 such that the alloy powder material is dropped little by little into the feeder cup 331 by a vibrating trough 333. This measuring operation is carried out while the feeder box 310 is gone away to the die 202*a*. When the feeder box 310 is back to the standby position, the feeder box 310 is supplied again by a robot 334. The weight of the alloy powder material to be put into the feeder cup 331 is set equal to the weight of the alloy powder material that is removed from the feeder box 310 by a single pressing operation. That is to say, the weight of the alloy powder material in the feeder box 310 is always kept constant. Since a constant amount of alloy powder material is always stored in the feeder box 310, a constant pressure is applied to the powder material that is dropping into the cavity 204 because of the pull of gravity. As a result, a constant weight of alloy powder material is loaded into the cavity 204.

A shaker 320, provided inside the feeder box 310, is secured to two supporting rods 312 by way of coupling bars 322*a*. The two supporting rods 312 extend parallelly through a pair of sidewalls 310*a*, which faces the direction in which the feeder box 310 is reciprocated. Both ends of each of these two supporting rods 312 are screwed up with coupling members 313. A second air cylinder 315 is secured to a fixing member 314, which is attached to the outer surface of the sidewall 310*a* on the right-hand side in FIG. 3(*b*). The cylinder shaft 315*a* of the air cylinder 315 is secured to the coupling member 313 on the right-hand side. By supplying the air through air supply tubes 315*b* to both ends of the air cylinder 315, the cylinder shaft 315*a* can be reciprocated, thereby reciprocating the shaker 320.

Upper and lower pairs of bar members 321 are provided for the shaker 320 so as to extend parallelly to the horizontal direction, i.e., the direction that is perpendicular to the longer-side direction of the cavity 204. These bar members 321 may be cylindrical bars, each having a circular cross section with a diameter of 0.3 mm to 7 mm, for example. The upper and lower pairs of bar members 321 are combined together by a supporting member 322 into a frame shape. By reciprocating the cylinder shaft 315*a* of the air cylinder 315, these bar members 321 can also go back and forth horizontally inside the feeder box 310. The pitch of the bar members 321 as measured in the direction in which they move is set substantially equal to the longer-side length of the cavity 204. The lower pair of bar members 321 is provided such that the lower end thereof is located 0.2 mm to 5 mm over the surface of the die surrounding the cavity 204. Also, the bar members 321, as well as the supporting member 322, are made of a stainless steel (e.g., SUS 304).

An $N_2$ gas supply pipe 323 to supply an inert gas into the feeder box 310 is connected to a point above the center of the right-hand-side sidewall 310*a* of the feeder box 310. The inert gas is supplied at a higher pressure than the atmospheric pressure so as to maintain an inert gas atmosphere inside the feeder box 310. Accordingly, even if some friction is created between the reciprocating shaker 320 and the alloy powder material, no firing should occur. Also, even when the feeder box 310 moves with the alloy powder material sandwiched between the bottom of the feeder box 310 and the base plate 201, no firing should be caused by the friction, either. Furthermore, even if some friction is created between the powder particles in the feeder box 310 due to the movement of the feeder box 310, no firing should occur, either.

A lid 310*d* is provided so as to close the powder storage 310A of the feeder box 310 airtight. In supplying the alloy powder material, this lid 310*d* shifts rightward in FIG. 3(*a*) to make the upper surface of the powder storage 310A open. For that purpose, a third air cylinder 317 to drive and open the lid 310*d* is provided for the sidewall 310*b*, which is located on the front side in FIG. 3(*a*). The air cylinder 317 and the lid 310*d* are coupled together via a fixing member 318 and screwed up with each other. To maintain an inert gas atmosphere, this lid 310*d* is normally located over the powder storage 310A of the feeder box 310. Only when the powder is supplied, the lid 310*d* moves rightward. It should be noted that a guide means (not shown) is provided on the other side of the lid 310*d*, which is opposed to the third air cylinder 317, to allow the lid 310*d* being driven and opened by the third air cylinder 317 to move smoothly. By supplying the air through air supply tubes 317*b* to both ends of the air cylinder 317, the cylinder shaft (not shown) is driven, thereby opening or closing the lid 310*d*.

Also, plate members 319, made of a fluorine resin and having a thickness of 5 mm, are screwed up with the bottom of the feeder box 310 such that no alloy powder material eats into the feeder box 310 or the base plate 1 (or the die set 202) in the gap between them by sliding the feeder box 310 on the base plate 201 with the fluorine resin plate members 319 interposed between them.

Hereinafter, it will be described how to perform the powder feeding operation with this powder material feeding mechanism 300.

First, an inert gas is introduced through the $N_2$ gas supply pipe 323 into the powder storage 310A of the feeder box 310. In such a state, the lid 310*d* of the feeder box 310 is opened, thereby feeding the predetermined amount of alloy powder material, which has been measured by the robot 334 with the feeder cup 331, into the powder storage 310A. Once the alloy powder material has been supplied, the lid 310*d* is closed to maintain the inert gas atmosphere inside the powder storage 310A. It should be noted that the inert gas is always supplied into the powder storage 310A, not just while the feeder box 310 is moving over the cavity 204, thereby minimizing the potential alloy powder material firing. Alternatively, Ar or He may also be used as the inert gas.

In such a state, the air cylinder 311 is started to drive the feeder box 310 toward the cavity 204 of the die 202. In this case, if the feeder box 310 is driven with the bar members 321 located on the front end of the direction of movement, then the alloy powder material on the front end of the movement direction will not be shifted toward the rear end of the movement direction as the feeder box 310 moves. Thus, the alloy powder material can be transported to the cavity 204 with the non-uniformity minimized.

After the feeder box 310 is positioned over the cavity 204 in this manner, the alloy powder material in the feeder box 310 is loaded down into the cavity 204 within the inert gas atmosphere while horizontally reciprocating the bar members 321 five to fifteen times, for example, inside the feeder box 310. The final rest positions, at which the bar members 321 should be eventually located after the horizontal movement, are defined such that all of those bar members 321 are kept off the opening 204*a* of the cavity 204. In this manner, the alloy powder material can be supplied into the cavity 204 at a relatively uniform fill density without running the risk of firing, for example. It should be noted, however, that the bar members 321 slice off the excessive alloy powder material that has overflowed from the cavity 204. Thus, traces (i.e., non-uniform distribution of loading weight or fill density) are formed on the surface of the alloy powder material that has been loaded into the cavity 204 in the direction in which the bar members 321 have moved (i.e., the same as the direction in which the feeder box 310 has moved). To minimize such a non-uniform distribution, the movement direction of the bar members 321 is preferably the shorter-side direction of the cavity 204.

Next, after the alloy powder material has been loaded and supplied into the cavity 204, the bar members 321 are shifted toward the front end of the backward direction of the feeder box 310, thereby preventing the alloy powder material on the front end of the (backward) movement direction from going back toward the rear end of the (backward) movement direction. Thereafter, the feeder box 310 is driven backward and the upper punch 205 is lowered, thereby compacting the alloy powder material in the cavity 204. In the meantime, the alloy powder material is newly supplied into the feeder box 310. The pressing process will be described in detail later.

By repeatedly performing these operations, the alloy powder material can be uniaxially pressed continuously. In the example described above, just one cavity 204 is provided. However, the same process is applicable for use even in a situation where multiple cavities 204 are provided. In that case, however, multiple bar members 321 are preferably provided at a pitch substantially corresponding to the pitch of the multiple cavities 204 as measured in the direction in which the feeder box 310 moves.

In this manner, the alloy powder material can be measured with the cavity 204, and can be loaded into the cavity 204, to the amount corresponding to the inner volume of the cavity 204. In this case, the fill density may be 2.2 g/cm$^3$ to 2.3 g/cm$^3$ and the filling ratio (i.e., the ratio of the relative density to the true density) may be 0.29 to 0.31.

Hereinafter, the uniaxial pressing process will be described.

In this preferred embodiment, by lowering the upper punch 205, the powder material is uniaxially pressed between the upper and lower press surfaces 205*a* and 203*a*. In this uniaxial pressing process, only the upper press surface 205*a* is deformed elastically but the inner surface 204*a* of the die hole 202*b* and the lower press surface 203*a* are substantially not deformed elastically although all of these surfaces contact with the powder material.

Figure 4:
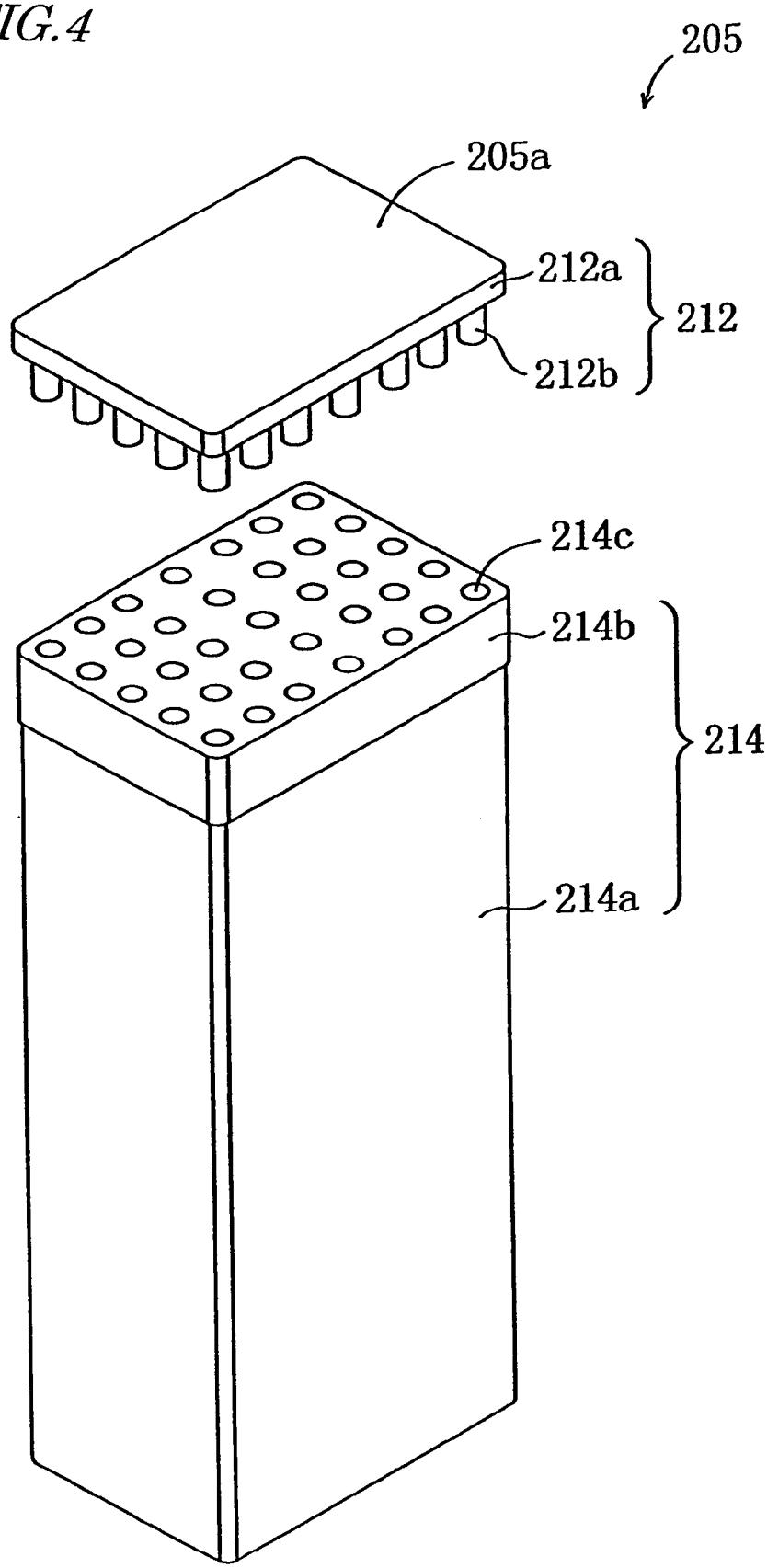
FIG. 4 is an exploded perspective view schematically illustrating an upper punch 205 to be provided for the powder compacting apparatus 200.

The structure of the upper punch 205 will be described with reference to FIG. 4. FIG. 4 is an exploded perspective view of the upper punch 205.

The upper punch 205 includes the resin layer 212 and the base 214. The surface of the resin layer 212 defines the upper press surface 205*a*. The base 214 is made of a stainless steel (e.g., SUS 304) while the resin layer 212 is made of a urethane resin with a Shore A hardness (according to ISO 868) of 75 to 80. A thermosetting urethane resin Ureol produced by Nihon Ciba Geigy Limited may be used as the urethane resin.

The resin layer 212 includes a flat plate portion 212*a* and anchor portions 212*b*. The anchor portions 212*b* are fitted into the holes 214*c* of the base 214 and may be secured to the base 214 with an adhesive if necessary. The anchor portions 212*b* are preferably provided to achieve a sufficient strength but may be omitted as well. The base 214 shown in FIG. 4 includes a body 214*a* and an end portion 214*b* having a surface to which the resin layer 212 is secured. Optionally, these portions may be combined together.

The thickness of the resin layer 212 (i.e., the thickness of the flat plate portion 212*a*) may be about 5 mm, for example. Each of the anchor portions 212*b* may have a cylindrical shape with a diameter of about 5 mm and a height of about 10 mm, for example. The flat plate portion 212*a* and the anchor portions 212*b* are integrated together. Such a resin layer 212 may be made of the thermosetting urethane resin described above by a casting process, for example.

This resin layer 212 has a Shore A hardness of 75 to 80. Accordingly, if the alloy powder material is pressed at a pressure of 660 kgf/cm$^2$ (i.e., 64.7 MPa), the resin layer 212 is deformed elastically in accordance with the non-uniform fill density distribution of the alloy powder material, thereby applying a uniform pressure onto the alloy powder material. By applying the pressure for a predetermined amount of time, a compact with a density of 4.1 g/cm$^3$ can be obtained. That is to say, the powder can be compacted to about 50% of the inner volume of the cavity 204 as a result of this uniaxial pressing process. This uniaxial pressing process may be controlled by a normal technique.

After the uniaxial pressing process is finished, the die 202 is lowered with the compacting pressure maintained at 33 kgf/cm$^2$ (i.e., 3.24 MPa), thereby exposing the side surface of the compact. Thereafter, the upper punch 205 is raised to unload the compact. In this case, the adhesion of the resin layer 212 (i.e., the upper press surface 205*a*) to the compact is weaker than that of the stainless steel plane (i.e., the lower press surface 203*a*) to the compact. Thus, the compact never goes up with the upper punch 205 and never drops or chips.

In the hold down technique in which the compact is extracted from the die hole while being sandwiched between the upper and lower punches, when the upper punch 205 leaves the cavity 204, the compact is released from the pressure that has been applied thereto by the inner surface 204*a* of the cavity 204. As a result, due to the springback force of the pressed compact, the resin layer 212 expands in the horizontal direction, or perpendicularly to the press axis direction. This expansion may pull the surface of the compact that is in contact with the resin layer 212, thus sometimes causing chipping around the periphery of the compact.

Figure 5:
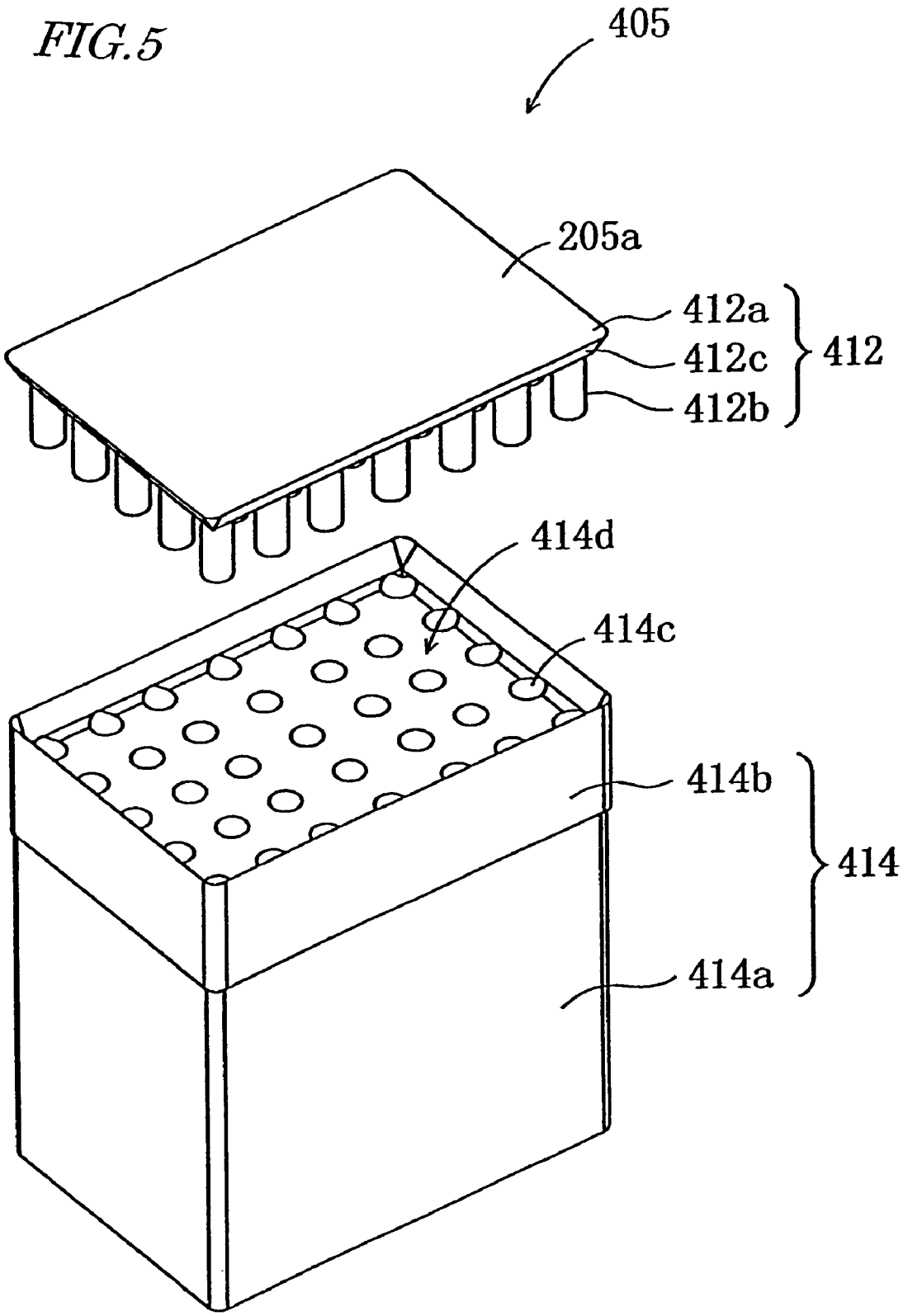
FIG. 5 is an exploded perspective view schematically illustrating another upper punch 405 for use in a powder compacting apparatus according to the present invention.

However, by using the upper punch 405 shown in FIG. 5 instead of the upper punch 205 shown in FIG. 4, such chipping resulting from the deformation of the resin layer can be minimized.

The upper punch 405 includes a resin layer 412 and a base 414. The surface of the resin layer 412 defines the upper press surface 205*a*. The base 414 is made of a stainless steel (e.g., SUS 304) while the resin layer 412 is made of a urethane resin with a Shore A hardness of 75 to 80.

The resin layer 412 includes a flat plate portion 412*a* and anchor portions 412*b*. The side surface 412*c* of the flat plate portion 412*a* defines a taper angle of about 60 degrees with respect to the press surface 405*a*.

The base 414 includes a concave portion 414*d* to receive the resin layer 412 therein. The anchor portions 412*b* of the resin layer 412 are fitted into the holes 414*c* of the base 414 and may be secured to the base 414 with an adhesive if necessary. The base 414 shown in FIG. 5 includes a body 414*a* and an end portion 414*b* having a surface to which the resin layer 412 is secured. Optionally, these portions may be combined together.

If the resin layer 412 is introduced into the concave portion 414*d* of the base 414 in this manner, then the side surface of the concave portion 414*d* can prevent the resin layer 412 from expanding in the horizontal direction, or perpendicularly to the press axis direction, due to the springback force of the pressed compact in the hold down process.

Figure 6A:
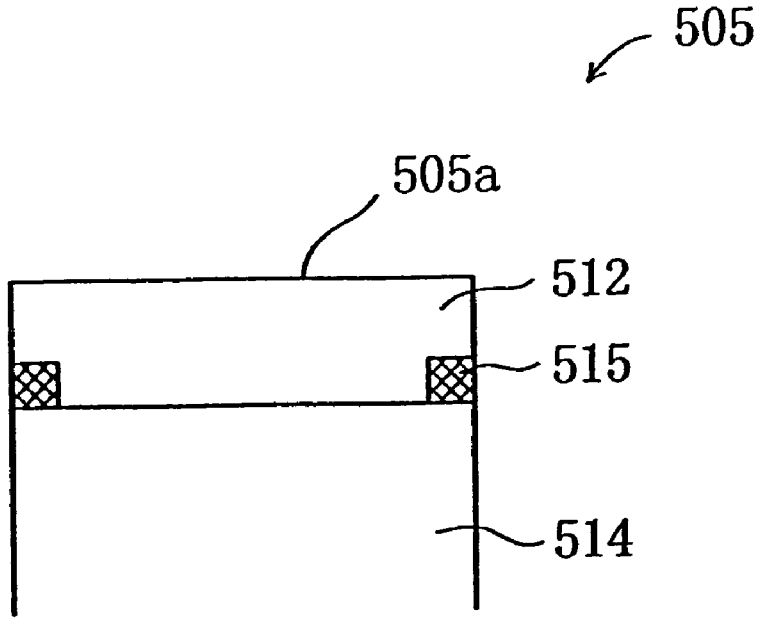
Figure 6B:
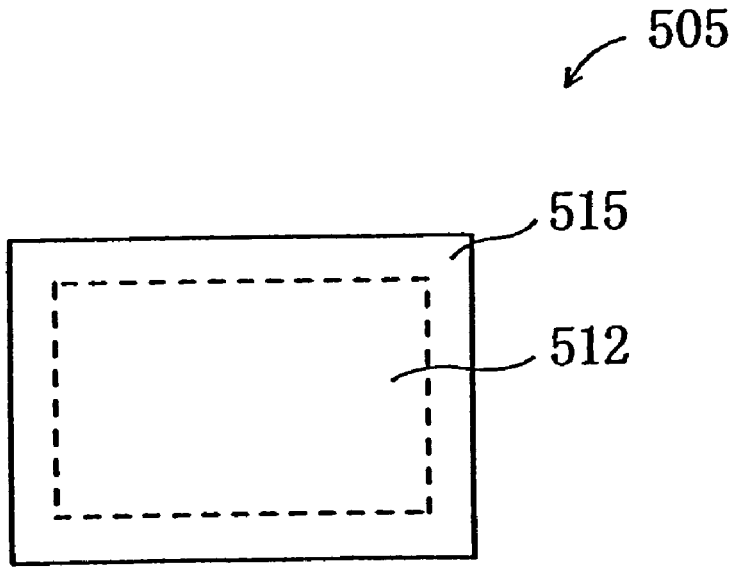

Alternatively, the upper punch 505 as schematically illustrated in FIGS. 6(*a*) and 6(*b*) may also be used. The upper punch 505 includes a base 514, a resin layer 512 and a deformation minimizing portion 515, which is provided so as to substantially surround the resin layer 512 (except the press surface 505*a*, though). The deformation minimizing portion 515 is made of a material (e.g., a resin or a metal) that has a higher elastic modulus than that of the material of the resin layer 512. Thus, the deformation minimizing portion 515 minimizes the resin layer 512 from expanding in the horizontal direction, or perpendicularly to the press axis direction, due to the springback force of the as-pressed compact.

Figure 7:
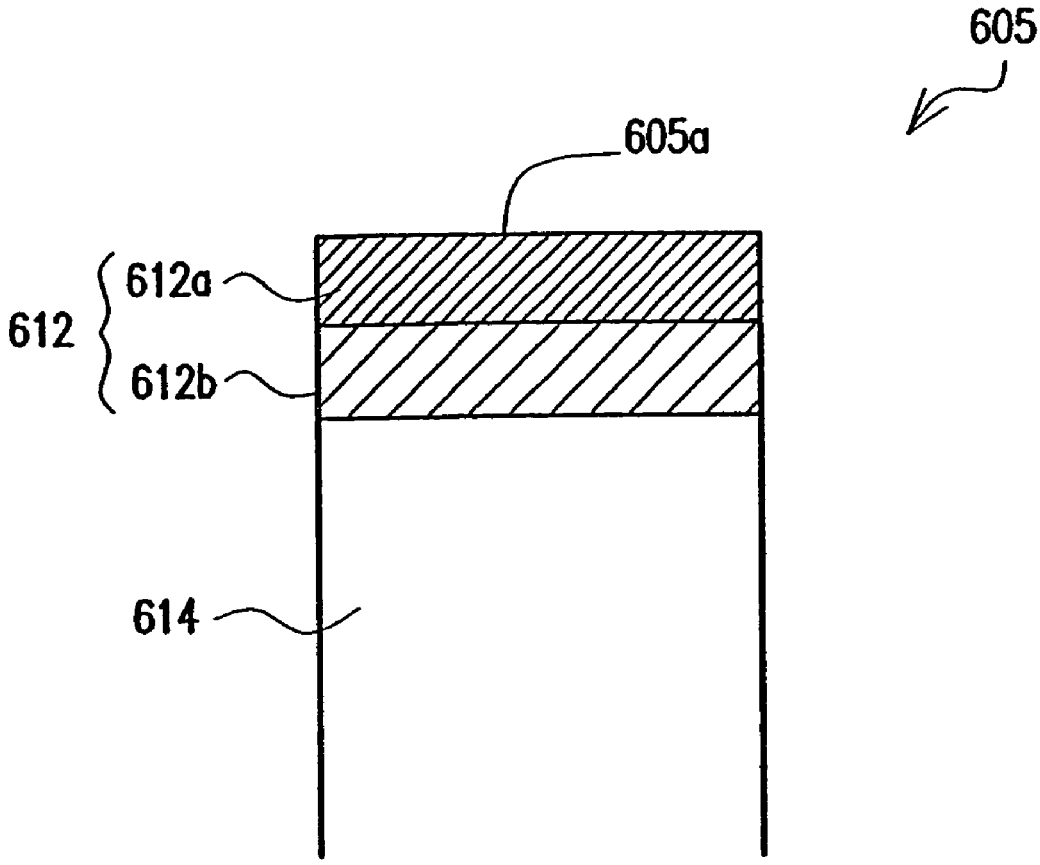
FIG. 7 is a cross-sectional view schematically illustrating another upper punch 605 for use in a powder compacting apparatus according to the present invention.

As another alternative, the upper punch 605 as schematically illustrated in FIG. 7 may also be used. The upper punch 605 includes a base 614 made of a stainless steel (e.g., SUS 304) and a resin layer 612 having a multilayer structure.

The resin layer 612 includes a first resin layer 612*a* and a second resin layer 612*b*, which are stacked one upon the other on the base 614 and which have mutually different hardness values. Specifically, the hardness of the first resin layer 612*a* is higher than that of the second resin layer 612*b*. Thus, the first resin layer 612*a* will be referred to herein as a "hard resin layer" 612*a* and the second resin layer 612*b* will be referred to herein as a "soft resin layer" 612*b*. The hard resin layer 612*a* is made of a urethane resin with a Shore A hardness of 70 to 90, while the soft resin layer 612*b* is made of a urethane resin with a Shore A hardness of 25 to 60. As can be seen from FIG. 7, the surface of the hard resin layer 612*a* defines the upper press surface 605*a* in this resin layer 612.

As described above, while the upper punch is extracted from the cavity, the resin layer may expand in the horizontal direction, or perpendicularly to the press axis direction. To minimize this expansion, the upper punches 405 and 505 shown in FIGS. 5 and 6 include a high-hardness deformation minimizing portion to receive the periphery of the resin layer. However, when any of these arrangements is adopted, the peripheral and central regions of the press surface have mutually different elastic moduli in the press axis direction. This may not be preferable to apply a uniform pressure to the alloy powder that has been loaded into the cavity.

In contrast, when the upper punch 605 including the resin layer 612 with a multilayer structure as shown in FIG. 7 is used, the elastic modulus of the resin layer 612 can be uniformized over the entire press surface 605*a*. Thus, the resultant compact can have a more uniform density.

Also, in the upper punch 605, the upper press surface 605*a* to contact with the compact is defined by the surface of the hard resin layer 612*a* and the soft resin layer 612*b* is provided between the hard resin layer 612*a* and the base 614. By adopting such an arrangement, even if the resin layer 612 expands in the horizontal direction, or perpendicularly to the press axis direction, while the upper punch 605 is being extracted from the cavity, the surface of the resin layer 612 (i.e., the surface of the hard resin layer 612*a*) is not damaged due to that expansion or the compact will not chip.

Figure 8A:
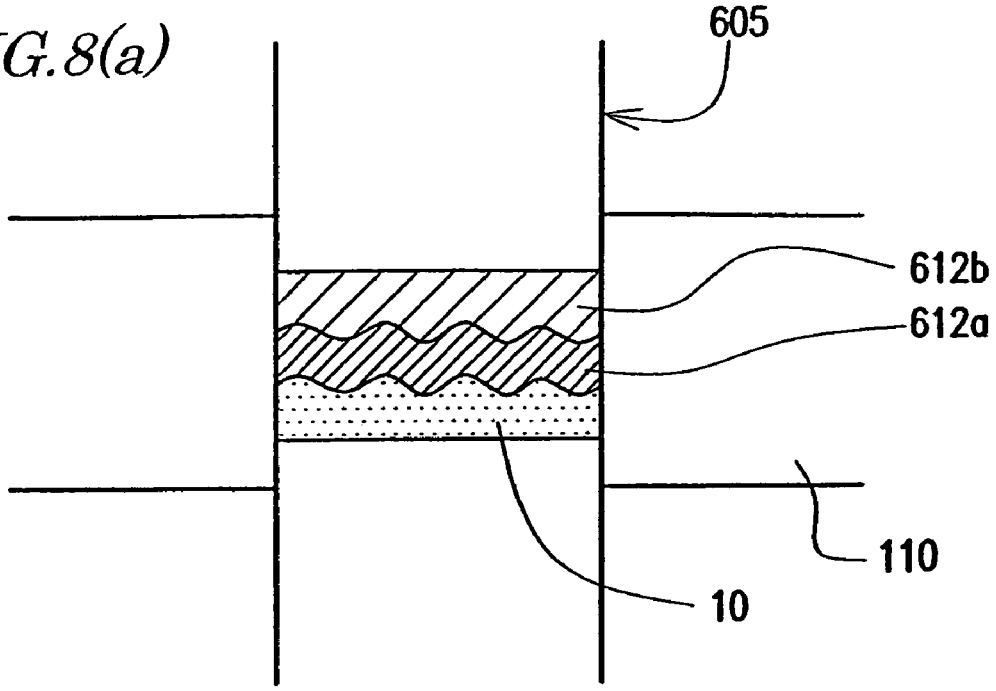
FIGS. 8(*a*) and 8(*b*) schematically illustrate a cross-sectional structure of the compacting apparatus that is performing a compacting process with the upper punch 605 shown in FIG. 7.
Figure 8B:
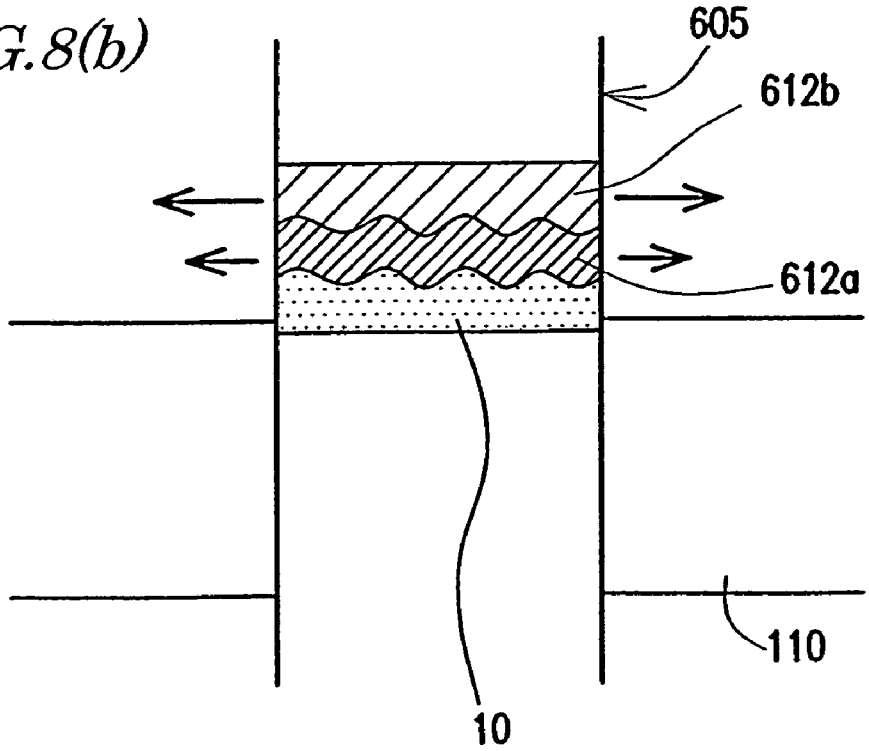

FIGS. 8(*a*) and 8(*b*) show how the powder material 10 may be compacted with the upper punch 605. As shown in FIG. 8(*a*), when a pressure is applied to the powder material 10 in the cavity, the soft resin layer 612*b* is deformed elastically in accordance with the variation in the fill density of the powder. However, since the hard resin layer 612*a* is provided, the soft resin layer 612*b* will not be deformed excessively. Accordingly, no excessive unevenness will be formed on the press surface to contact with the compact (i.e., on the surface of the hard resin layer 612*a*).

It should be noted that the shapes of the press surfaces during the compaction process may be controlled by adjusting the ratio of the thickness of the hard resin layer 612*a* to that of the soft resin layer 612*b*, for example. If there is not so significant variation in the fill density of the powder, then the hard resin layer 612*a* may have a relatively small thickness, for instance.

While the upper punch 605 is extracted from the cavity by lowering the die 110 after the compaction process has been carried out in this manner, the resin layers 612*a* and 612*b* are going to extend in the horizontal direction, or perpendicularly to the press axis direction, due to the springback force of the compact or the expansion of the resin layers themselves as shown in FIG. 8(*b*).

However, the press surfaces, which are in contact with the compact, have not been deformed excessively. Accordingly, even when the expanding force described above is acting on the press surfaces, the compact or the resin layers will not be damaged. In addition, the compact can also be removed from the punches advantageously.

Also, since the soft resin layer 612*b* is provided, the expanding force of the hard resin layer 612*a* may be relaxed. During the compaction process, the soft resin layer 612*b* is deformed to a great degree but the hard resin layer 612*a* is deformed to a small degree. Accordingly, the expansion of the hard resin layer itself may be reduced. Thus, the stress on the surface of the hard resin layer 612*a* (i.e., the press surface) can be reduced and cracking of that surface can be minimized. As a result, it is possible to prevent the compact from chipping.

Figure 9:
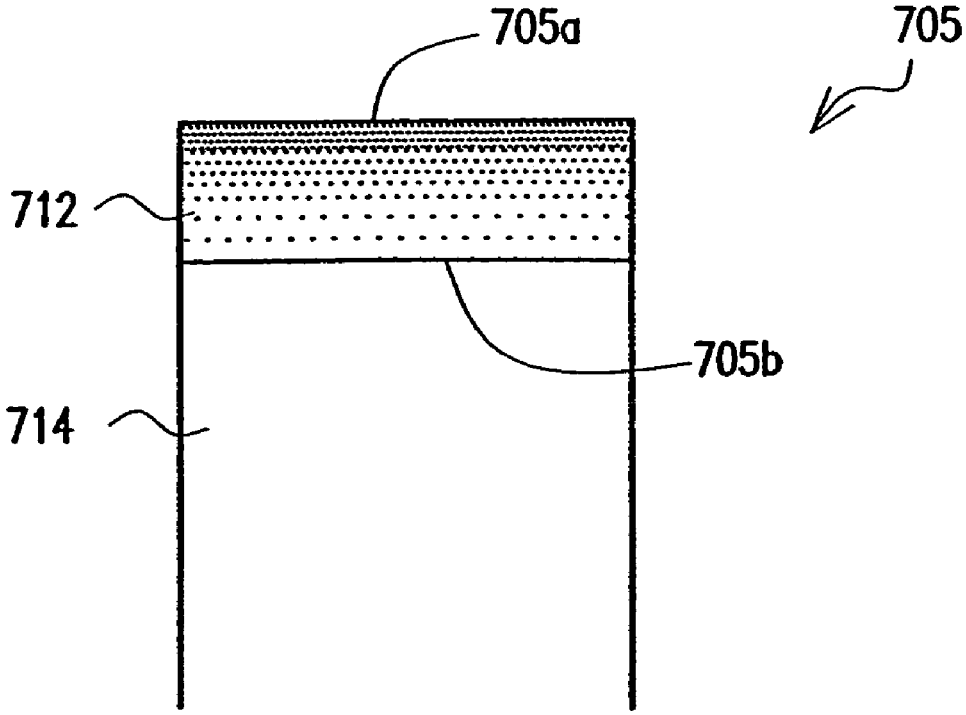
FIG. 9 is a cross-sectional view schematically illustrating another upper punch 705 for use in a powder compacting apparatus according to the present invention.

In the example described above, the two resin layers 612*a* and 612*b* are used. Alternatively, the resin layer 612 with the multilayer structure may consist of three or more resin layers with mutually different hardness values. As another alternative, an upper punch 705 having a resin layer 712 of which the hardness changes gradually in the press axis direction may also be used as shown in FIG. 9. In that case, the hardness of the resin layer 712 preferably decreases gradually from the surface 705*a* of the resin layer 712 toward the junction plane 705*b* between the resin layer 712 and the base 714.

Also, when the compaction process is carried out with an upper punch including a resin layer as described above, the powder material may be compacted after an easily deformable thin cloth member (i.e., a member that can change its shape with the elastic deformation of the resin layer) has been sandwiched between the surface of the resin layer and the powder material. By performing the compaction process in this manner, the compact will not be in direct contact with the surface of the resin layer, and therefore, the adhesion between them may be reduced. As the cloth member, a filter cloth (such as felt), which is generally used in a wet molding process, may be used.

In the uniaxial pressing process described above, a magnetic field of about 1.3 MA/m is applied by the magnetic field generating coils 206 perpendicularly to the uniaxial pressing direction (i.e., the press axis direction).

In the compact obtained in this manner, chipping, cracking or deformation has rarely occurred and the orientation directions of alloy powder particles have also been aligned sufficiently under the magnetic field.

The compact obtained in this manner is sintered at a temperature of about 1,000° C. to about 1,180° C. for approximately 1 to 2 hours, for example. Then, the resultant sintered body is subjected to an aging treatment at a temperature of about 450° C. to about 800° C. for approximately 1 to 8 hours, thereby obtaining an R—Fe—B based sintered magnet. To reduce the amount of carbon included in the sintered magnet and thereby improve the magnetic properties thereof, the lubricant that covers the surface of the alloy powder is preferably burned off before the compact is subjected to the sintering process. The burn off process may be carried out at a temperature of about 200° C. to about 600° C. and at a pressure of about 2 Pa for approximately 3 to 6 hours.

A compact having a uniform density distribution is obtained by an inventive method for producing a magnet. Thus, the compact hardly chips, cracks or deforms through the sintering process. As a result, a sintered magnet exhibiting excellent magnetic properties can be produced at a high productivity.

Figure 10A:
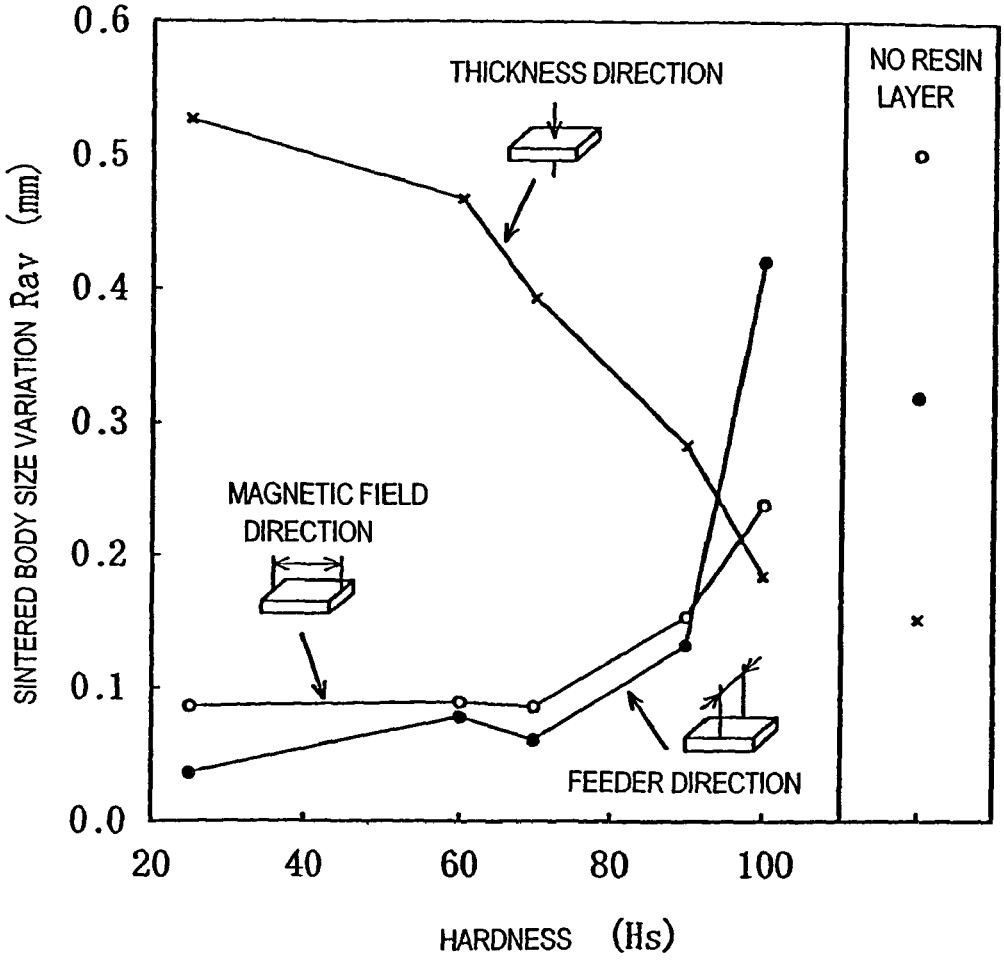
FIG. 10(*a*) shows the results of estimated variations in the size of sintered bodies obtained by the method for producing a magnet according to the invention along with the results that were estimated for sintered bodies obtained by the conventional manufacturing process.
Figure 10B:
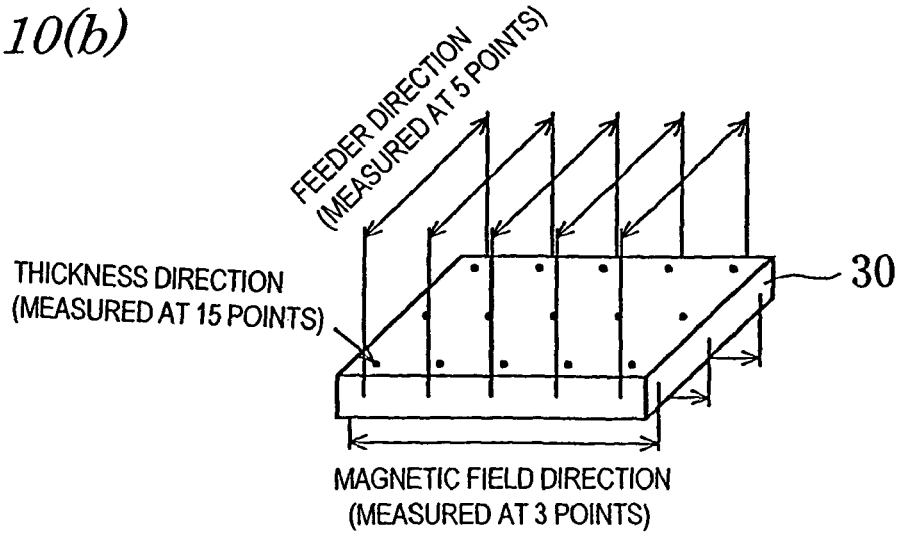

Hereinafter, the effects of the inventive powder pressing method will be described with reference to FIGS. 10(*a*) and 10(*b*). FIG. 10(*a*) shows the results of estimated variations in the size of sintered bodies obtained by the method for producing a magnet according to the embodiment described above along with the results that were estimated for sintered bodies obtained by the conventional manufacturing process. FIG. 10(*b*) is a schematic representation showing a method for estimating a size variation.

In producing the sintered bodies representing examples of the present invention, the upper punch 205 shown in FIG. 4 was used as the upper punch of the powder compacting apparatus 200. On the other hand, in producing the sintered bodies representing conventional examples, an upper punch with a press surface made of a stainless steel (SUS 304) and including no resin layer 212 was used instead of the upper punch 205 of the powder compacting apparatus 200.

In FIG. 10(*a*), the abscissa represents the Shore A hardness of the resin layer 212 with the results of the punch with no resin layer (i.e., conventional examples) shown on the right hand side. On the other hand, the ordinate of FIG. 10(*a*) represents the size variation Rav (mm).

As the materials of the resin layer 212, a silicone rubber with a Shore A hardness of 25, urethane rubbers with Shore A hardnesses of 60, 70 and 90, respectively, and a resin with a Shore A hardness exceeding 100 (e.g., Jurakon™) were used.

The size variation R was obtained in the following manner.

First, as shown in FIG. 10(*b*), 15 measuring points are set for each sintered body 30, and the difference between the maximum and minimum thicknesses (will be referred to herein as the variation R) that were measured in each of the magnetic field direction (at three points), the feeder moving direction (at five points) and the thickness direction (at 15 points) was obtained. These size variations R were obtained in the respective directions for each of the five sintered bodies 30 and the average thereof was regarded as the size variation Rav.

As is clear from FIG. 10(*a*), when a resin layer with a Shore A hardness of 90 or less was used, the size variations Rav were smaller in the magnetic field direction and in the feeder direction than the situation where no resin layer was used or the situation where a resin layer with a Shore A hardness exceeding 100 was used. Conversely, the size variation Rav in the thickness direction increased in the situation where the resin layer with the Shore A hardness of 90 or less was used. These results show that the resin layer with the Shore A hardness of 90 or less was deformed elastically in accordance with the non-uniform fill density distribution during the uniaxial pressing process. Also, the size variation Rav in the thickness direction in the situation where the resin layer with the Shore A hardness exceeding 100 (e.g., Jurakon™) was used was almost the same as the situation where no resin layer was provided. Thus, it can be seen that the resin layer with the Shore A hardness exceeding 100 was hardly deformed elastically during the pressing process and did not sufficiently counterbalance the non-uniform fill density distribution.

Furthermore, if a resin layer with a Shore A hardness of 70 or less was used, the size variations Rav were substantially constant, small values in the magnetic field direction and in the feeder direction, while the size variation Rav in the thickness direction increased as the Shore A hardness decreased. That is to say, when a resin layer with a Shore A hardness of 70 was used, the size variations Rav in the magnetic field direction and in the feeder direction were sufficiently small and the size variation Rav in the thickness direction could be relatively small. Thus, it is believed that the preferred Shore A hardness range of the resin layer is preferably defined by the Shore A hardness of 70 as its center value, i.e., from 60 to 85.

Figure 11A:
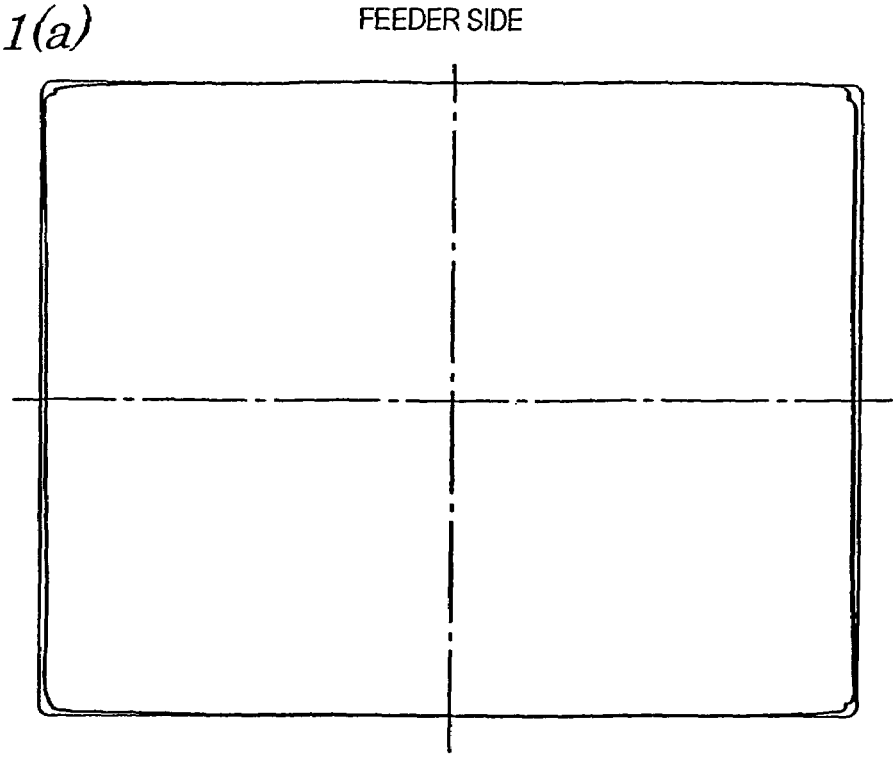
FIG. 11(*a*) shows the outer peripheral shape of a sintered body, which was obtained by using a resin layer with a Shore A hardness of 70.
Figure 11B:
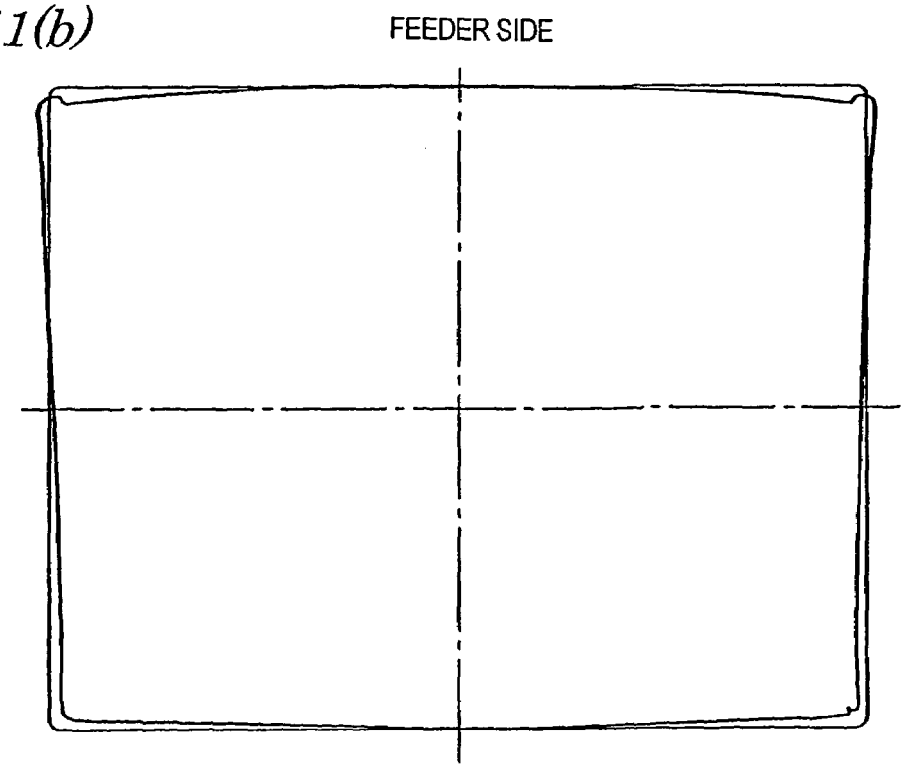

FIG. 11(*a*) shows the outer (peripheral) shape of a sintered body, which was obtained by using a resin layer with a Shore A hardness of 70, as viewed in the press axis direction. FIG. 11(*b*) shows the outer peripheral shape of a sintered body, which was obtained by using an upper punch with no resin layer, as viewed in the same direction.

Figure 12:
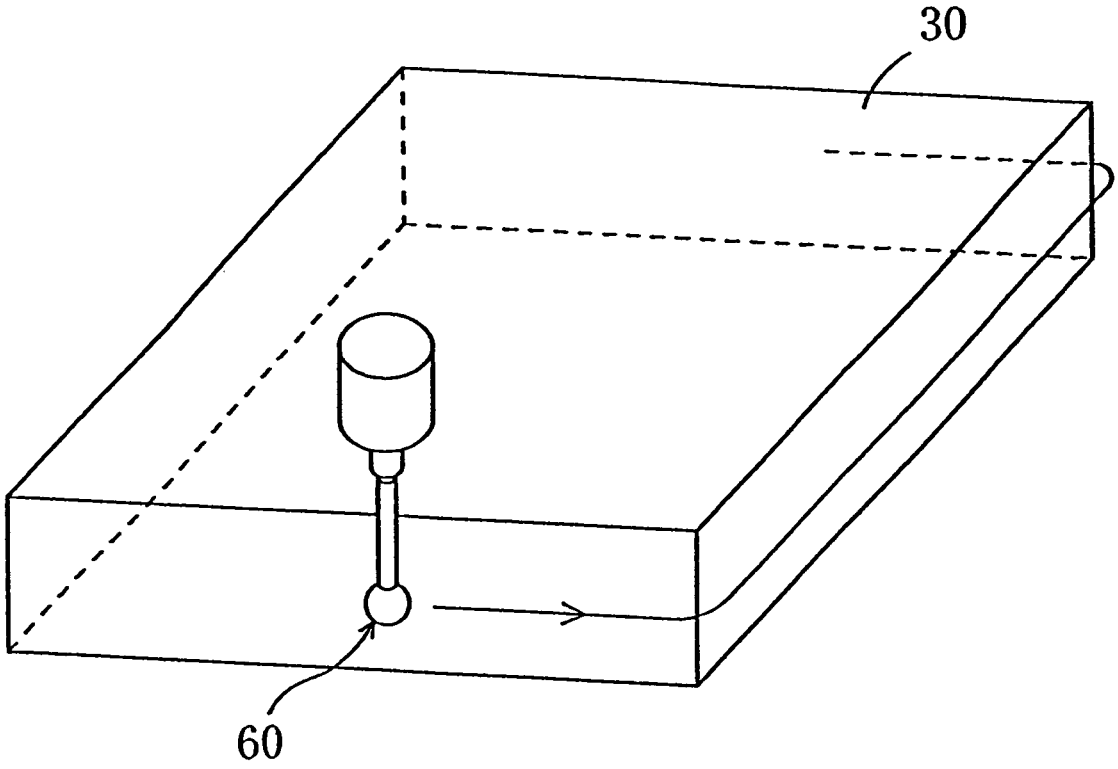
FIG. 12 schematically shows how to obtain the outer peripheral shapes shown in FIGS. 11(*a*) and 11(*b*).

In each of FIGS. 11(*a*) and 11(*b*), the bold line represents the deviation of the outer peripheral shape of its associated sintered body from the predetermined outer peripheral shape as indicated by the solid line. The deviation is herein exaggerated fivefold. The outer peripheral shape of each sintered body was obtained as the trace of an instrument 60, which was moved in the direction indicated by the arrow in FIG. 12, for example, while keeping contact with the side surfaces of the sintered body 30 as shown in FIG. 12.

As is clearly seen when the results shown in FIGS. 11(*a*) and 11(*b*) are compared to each other, the sintered body obtained by the inventive manufacturing process is much less distorted than the sintered body obtained by the conventional manufacturing process. These results show that a compact with a uniform density could be obtained by performing the uniaxial pressing process using an appropriately elastically deformable resin layer.

As can be seen, in the sintered body obtained by the inventive manufacturing process, just one surface thereof that has been in contact with the elastically deformable press surface during the pressing process is uneven, while the other surfaces thereof have the predetermined shape (i.e., flat). Accordingly, by grinding only the surface that has been in contact with the elastically deformable press surface, a sintered body with predetermined sizes and shape can be obtained. In contrast, the sintered body obtained by the conventional manufacturing process has all of its surfaces distorted significantly as shown in FIG. 11(*b*). For that reason, to obtain a sintered body with the predetermined sizes and shape, all of those surfaces need to be processed. Thus, according to the manufacturing process of this embodiment, just one surface needs to be processed and the throughput can be increased. In addition, the processing margin (or the grinding margin) can be reduced and the yield of the material also increases.

INDUSTRIAL APPLICABILITY

The present invention provides a powder compacting method that can make a compact with a uniform density distribution at a high productivity even from a powder material with a non-uniform fill density distribution, and also provides a powder compacting apparatus that can be used effectively to carry out such a powder compacting method. In particular, according to the powder compacting method of the present invention, a thin compact can be obtained at a high productivity from a powder material with a low flowability.

The powder compacting apparatus of the present invention can be easily obtained just by making the press surface of a conventional uniaxial press (i.e., a die press) of a resin layer with an appropriate hardness, for example. Thus, the present invention can be carried out easily.

Furthermore, the powder compacting method of the present invention makes it possible to produce a compact with a uniform density from a rare earth alloy powder that has been prepared by a strip casting process. Thus, the present invention provides a method for producing a rare earth sintered magnet at a high productivity.

The invention claimed is:

1. A method for producing a magnet, comprising the steps of:

providing a powder material including a rare earth alloy powder;

loading the powder material into a cavity;

uniaxially pressing the powder material, which has been loaded into the cavity, between two opposed press surfaces, thereby obtaining a compact, wherein at least one of the two press surfaces is deformed elastically under a compacting pressure when contacting with the powder material in the cavity; and unloading the compact from the cavity.

2. The magnet producing method of claim 1, wherein the at least one press surface is the surface of a resin layer.

3. The magnet producing method of claim 2, wherein the resin layer has a Shore A hardness of 25 to 90.

4. The magnet producing method of claim 1, wherein in the uniaxially pressing step, just one of the two press surfaces is deformed elastically under the compacting pressure.

5. The magnet producing method of claim 1, wherein the loading step includes the step of measuring the powder material with the cavity.

6. The magnet producing method of claim 1, wherein the loading step includes the step of filling the cavity with the powder material at a relative density of 0.20 to 0.35.

7. The magnet producing method of claim 6, wherein the uniaxially pressing step includes the step of uniaxially pressing the powder material to a volume that is 0.5 to 0.65 time as large as the content volume of the cavity.

8. The magnet producing method of claim 1, wherein the compact satisfies $D \leqq |S^{1/2}|/3$, where D is the thickness (mm) of the compact as measured in a press axis direction in the uniaxially pressing step and S is the area ($mm^2$) of each of the two press surfaces.

9. The magnet producing method of claim 1, further comprising the step of aligning the rare earth alloy powder by applying a magnetic field thereto perpendicularly to the press axis direction during the uniaxially pressing step.

10. The magnet producing method of claim 1 wherein in the uniaxially pressing step, the press axis direction is defined vertically, the two press surfaces consist of an upper press surface and a lower press surface, the side surface of the cavity is defined by an inner surface of a die, and the bottom of the cavity is defined by the lower press surface.

11. The magnet producing method of claim 1, further comprising the steps of:

sintering the compact to obtain a sintered body; and finishing the surface of the sintered body, wherein the surface finishing step includes the step of selectively grinding only a surface of the sintered body that contacted with the at least one press surface in the uniaxially pressing step.

12. A powder compacting apparatus for uniaxially pressing a powder material that has been loaded into a cavity, the apparatus comprising:

a die having an inner surface that defines the side surface of the cavity;

a lower punch having a lower press surface that defines the bottom of the cavity; and an upper punch having an upper press surface that is opposed to the lower press surface, wherein in uniaxially pressing the powder material, which has been loaded into the cavity, between the lower and upper press surfaces, at least one of the lower and upper press surfaces is selectively deformed elastically under a compacting pressure among the inner surface, the lower press surface and the upper press surface that define the cavity, the at least one press surface is the surface of a resin layer, the upper press surface is deformed elastically under the compacting pressure, the upper punch includes a resin layer, portion of which changes its hardness in the press axis direction, and the upper press surface is the surface of the resin layer.

13. The powder compacting apparatus of claim 12, wherein the resin layer has a Shore A hardness of 25 to 90.

14. The powder compacting apparatus of claim 12, wherein just one of the lower and upper press surfaces is deformed elastically under the compacting pressure.

15. The powder compacting apparatus of claim 12, wherein the upper press surface is to surface of a resin layer, and wherein the upper punch includes a member for preventing the resin layer from expanding in a horizontal direction, which is perpendicular to the press axis direction, under the compacting pressure.

16. The powder compacting apparatus of claim 15, wherein the upper punch includes a concave portion to receive the resin layer, and wherein the side surface of the concave portion prevents to resin layer from expanding in the horizontal direction that is perpendicular to the press axis direction under the compacting pressure.

17. The powder compacting apparatus of claim 12, wherein the resin layer includes:

a first resin layer with a first hardness; and a second resin layer with a second hardness that is lower than the first hardness, and wherein the upper press surface is the surface of the first resin layer.

* * * * *